US007212777B2

(12) United States Patent
Takada et al.

(10) Patent No.: US 7,212,777 B2
(45) Date of Patent: May 1, 2007

(54) IMAGE FORMING APPARATUS USED IN ELECTROSTATIC PROCESS

(75) Inventors: Takeshi Takada, Yokohama (JP); Takaaki Ikegami, Susono (JP); Akihiro Sugino, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 143 days.

(21) Appl. No.: 11/065,093

(22) Filed: Feb. 25, 2005

(65) Prior Publication Data

US 2005/0201778 A1 Sep. 15, 2005

(30) Foreign Application Priority Data

Feb. 25, 2004 (JP) ..... 2004-048939
Feb. 23, 2005 (JP) ..... 2005-046708

(51) Int. Cl.
*G03G 21/00* (2006.01)

(52) U.S. Cl. ..... 399/350; 399/159; 399/346; 430/110.1

(58) Field of Classification Search ..... 399/350, 399/343, 346, 352, 353, 357, 159; 430/125, 430/110.1, 110.3, 110.4
See application file for complete search history.

(56) References Cited

U.S. PATENT DOCUMENTS 6,442,367 B1 * 8/2002 Itami et al. ..... 430/125 X
6,741,821 B2 5/2004 Sugino et al. ..... 399/111
6,785,500 B2 8/2004 Takahashi et al. ..... 399/297
2002/0028100 A1 * 3/2002 Kubo et al. ..... 399/350
2003/0118359 A1 6/2003 Ogiyama et al. ..... 399/45
2004/0224245 A1 * 11/2004 Shigezaki et al. ..... 399/159 X
2004/0240915 A1 * 12/2004 Nakayama ..... 399/350 X
2006/0141378 A1 6/2006 Takada et al.

FOREIGN PATENT DOCUMENTS

JP 2002-221886 8/2002
JP 2003-131537 5/2003
JP 2004-325924 A * 11/2004

OTHER PUBLICATIONS

U.S. Appl. No. 11/366,469, filed Mar. 3, 2006, Sugino et al.

* cited by examiner

*Primary Examiner*—Sophia S. Chen
(74) *Attorney, Agent, or Firm*—Oblon, Spivak, McClelland, Maier & Neustadt, P.C.

(57) ABSTRACT

An image forming apparatus including an image bearing member to bear a latent electrostatic image, an irradiation device and developing device to develop a toner latent electrostatic image on the image bearing member, a cleaning blade to remove toner particles remaining on the image bearing member, and a transfer device to transfer the toner image formed on the image bearing member to a recording material. The image forming apparatus satisfies relationships (1) and (2): (1) 0.10< or =$Dm^3/V$< or =3.41, wherein Dm represents a weight average particle diameter of the toner and V represents a circumference velocity of the image bearing member; and (2) $T_{ave}$< or =1.40 kgf·cm, wherein $T_{ave}$ represents the average of a torque T of the image bearing member when the torque is measured for 15 seconds while the cleaning blade is in contact with the image bearing member.

22 Claims, 7 Drawing Sheets

IMAGE FORMING APPARATUS USED IN ELECTROSTATIC PROCESS

BACKGROUND OF THE INVENTION

1. Field of the Invention

The present invention relates to an image forming apparatus for use in image formation using an electrostatic photocopying process such as photocopiers, facsimile machines, printers, etc.

2. Discussion of the Background

Recently, high speed, size reduction and high definition full color images have been demanded for image forming apparatuses for use in image formation using an electrostatic photocopying process such as a photocopier or a printer. To obtain such high definition images, toners having a small particle diameter are used irrespective of the kind of the toners, i.e., pulverized toners and polymerized toners. However, such small-sized toners have a large surface area per a unit weight and therefore the toners have low fluidity and relatively large adhesion. This leads to deterioration of cleaning performance of removing residual toner particles. Therefore, an external additive functioning as a fluidizer is added in a large amount of quantity to the toner to compensate for the decrease in the fluidity. Nevertheless, there is still a disadvantage in that good cleaning performance for such a toner is not securely obtained.

In addition, spherical toners are typically used to obtain a high definition image because such toners have good developability and transferability. Spherical form toners have good fluidity but tend to roll. This leads to a problem in that, when a blade cleaning system is adopted in a high speed image forming apparatus, the toner particles sneak through the blades, resulting in poor cleaning performance.

Cleaning systems are broadly classified into blade cleaning systems and brush cleaning systems. Blade cleaning systems are preferably used in a small-sized image forming apparatus in terms of structure and cost. Therefore, a blade cleaning system with good cleaning performance is desired even when spherical toners having a small particle diameter are used.

Countermeasures against the poor cleaning performance problem with toners having a small particle diameter and a spherical form can be taken from the standpoints of the toner and process.

As for a countermeasure from the standpoint of the toner, unexamined published Japanese Patent Application No. (hereinafter referred to as JOP) 2003-131537 discloses an image forming apparatus containing a cleaning device having a rubber blade and a mechanism for transporting toner particles collected by the cleaning device to a developing device, wherein the toner for use in the image forming apparatus has a volume average particle diameter (d) of from 4 to 10 μm and has a flatness ratio (d/t) of the volume average particle diameter (d) to the thickness (t) of from 2 to 5.

As for a countermeasure against the poor cleaning performance problem from the standpoint of process, JOP 2002-221886 discloses an image forming method in which the following relationships are satisfied: $0.2 \geqq Y100-Y0 \geqq 0.01$ and $2.95 \geqq Y100/Y0 \geqq 1.15$ (the unit of Y100 and Y0 is N·m), wherein Y0 represents the average value of dynamic torque created between an organic image bearing member and a cleaning blade when a toner image is not formed on the organic image bearing member and Y100 represents the average value of dynamic torque when a 100% solid toner image is formed on the organic image bearing member.

However, countermeasures from the standpoint of either toner or process are not sufficient to avoid the cleaning problem with toners having a small particle diameter and a spherical form. Especially an image forming apparatus having good ability is desired even when toners having a small toner particle diameter is used to satisfy the demands to produce high definition images at a high speed.

Because of these reasons, a need exists for an image forming apparatus in which toner particles remaining on the surface of an image bearing member can be removed with a cleaning blade even when the toner has a small particle diameter.

SUMMARY OF THE INVENTION

Accordingly, an object of the present invention is to provide a novel image forming apparatus that is small in size and can produce quality images at a high speed even when a toner has a small particle diameter is used. Briefly this object and other objects of the present invention as hereinafter will become more readily apparent can be attained by a novel image forming apparatus containing an image bearing member configured to bear a latent electrostatic image thereon and that contains an electroconductive substrate and a photosensitive layer located overlying the electrocondcutive substrate, a charging device configured to irradiate the image bearing member with light, a developing device configured to develop the latent electrostatic image on the image bearing member with a toner to form a toner image on the surface of the image bearing member, a cleaning device containing a cleaning blade configured to scrape the surface of the image bearing member to remove particles of the toner remaining on the image bearing member, and a transfer device configured to transfer the toner image formed on the image bearing member to a recording material directly or by way of an intermediate transfer member. The image forming apparatus satisfies the following relationships (1) and (2): (1) $0.10 \leqq Dm^3/V \leqq 3.41$, wherein Dm represents a weight average particle diameter of the toner and V represents a circumference velocity of the image bearing member; and (2) $T_{ave} \leqq 1.40$ kgf·cm, wherein $T_{ave}$ represents an average of torque T of the image bearing member when the torque is measured for 15 seconds while the cleaning blade is in contact with the image bearing member.

It is preferred that the toner for use in the image forming apparatus mentioned above has a weight average particle diameter Dm of from 4.0 to 8.0 μm and the image bearing member has a circumference velocity V of from 150 to 600 mm/sec.

It is still further preferred that the image bearing member further contains a protective layer as an outermost layer of the photosensitive layer and which contains a particulate fluorine resin functioning as a solid lubricant in an amount of 20 to 60% by volume.

It is still further preferred that, in the image forming apparatus, the protective layer further contains a charge transport material.

It is still further preferred that the image forming apparatus contains a contacting member configured to extend particulate fluorine resin contained in the protective layer by scraping the surface of the image bearing member.

It is still further preferred that the cleaning blade functions as the contacting member.

It is still further preferred that the image forming apparatus contains a member configured to supply a solid lubricant to an outermost layer of the image bearing member.

It is still further preferred that the image forming apparatus further contains at least one additional image bearing member.

It is still further preferred that the image forming apparatus further contains a process cartridge containing the image bearing member and at least one device selected from the group consisting of the charging device, the developing device, and the cleaning device.

It is still further preferred that the toner for use in the image forming apparatus has an average circularity of from 0.93 to 1.00 and is prepared by a method in which a toner component including a particulate resin polymer having a portion reactive with a compound having an active hydrogen, a polyester, a colorant, and a releasing agent is cross-linked or elongated in an aqueous liquid under the presence of a particulate resin polymer.

It is still further preferred that particles of the toner for use in the image forming apparatus of the present invention have a substantially sphere form and that a ratio (r2/r1) of a minor axis (r2) of the particles of the toner to a major axis (r1) thereof is from 0.5 to 1.0 and another ratio (r3/r2) of a thickness (r3) of the toner to the minor axis (r2) thereof is from 0.7 to 1.0, wherein the following relationship is satisfied: major axis r1> or =minor axis r2> or =thickness r3.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

The present invention will be described below in detail with reference to several embodiments and accompanying drawings.

Figure 1:
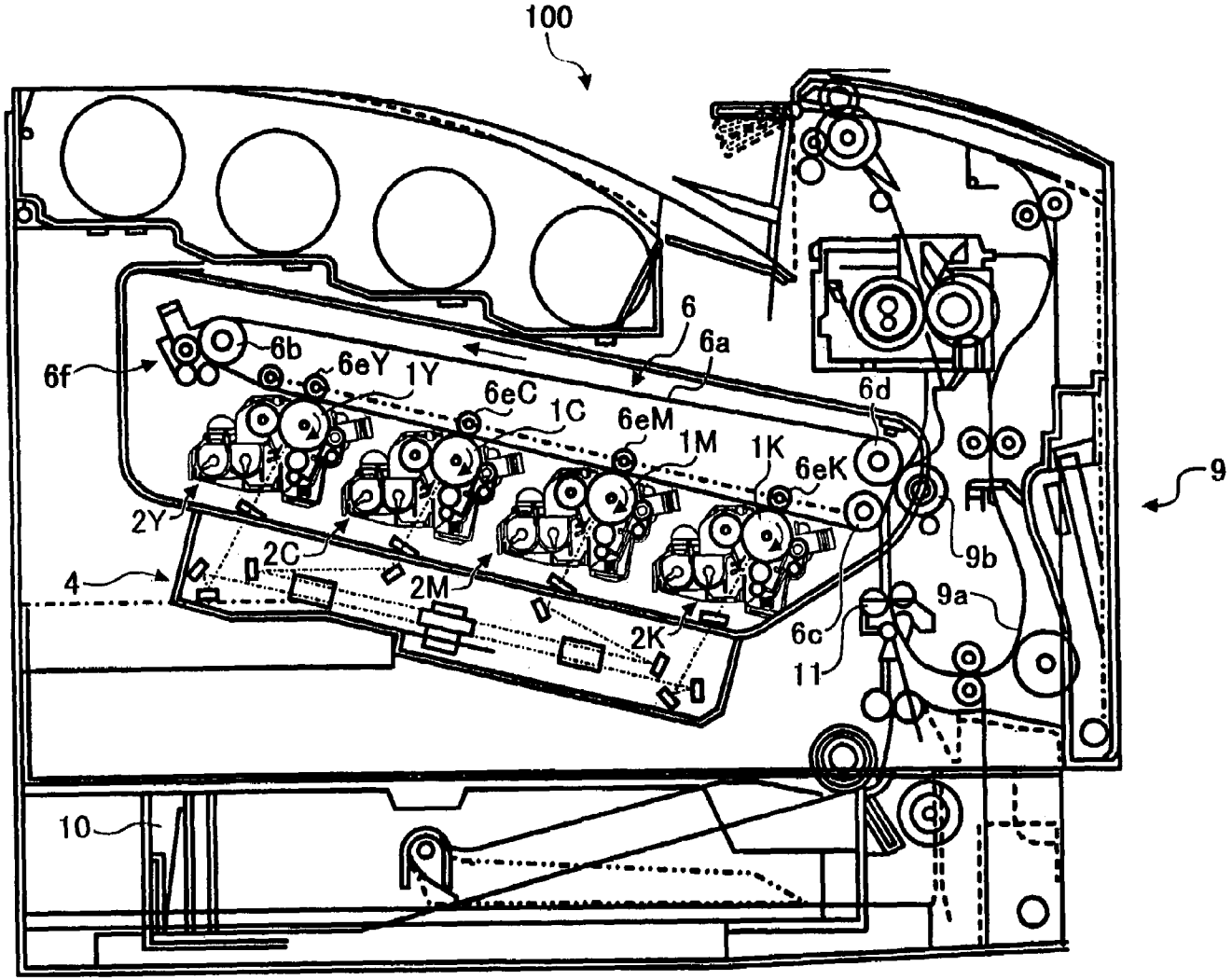
FIG. 1 is a schematic diagram illustrating the structure of an image forming apparatus of an embodiment of the present invention.

FIG. 1 is a schematic diagram illustrating an example of the image forming apparatus of an embodiment of the present invention. An embodiment of the present invention is now described using an image forming apparatus 100 adopting an electrophotographic system. The image forming apparatus 100 is a tandem type image forming apparatus that can produce color images using four color toners, i.e., yellow (hereinafter referred to as "Y"), cyan (hereinafter referred to as "C"), magenta (hereinafter referred to as "M") and black (hereinafter referred to as "K") The image forming apparatus 100 contains four image bearing members 1Y, 1C, 1M and 1K as latent image bearing members. Each image bearing member of 1Y, 1C, 1M and 1K rotates in the direction indicated by arrows in FIG. 1 while each is in contact with an intermediate belt 6*a* functioning as a surface moving member.

Figure 2:
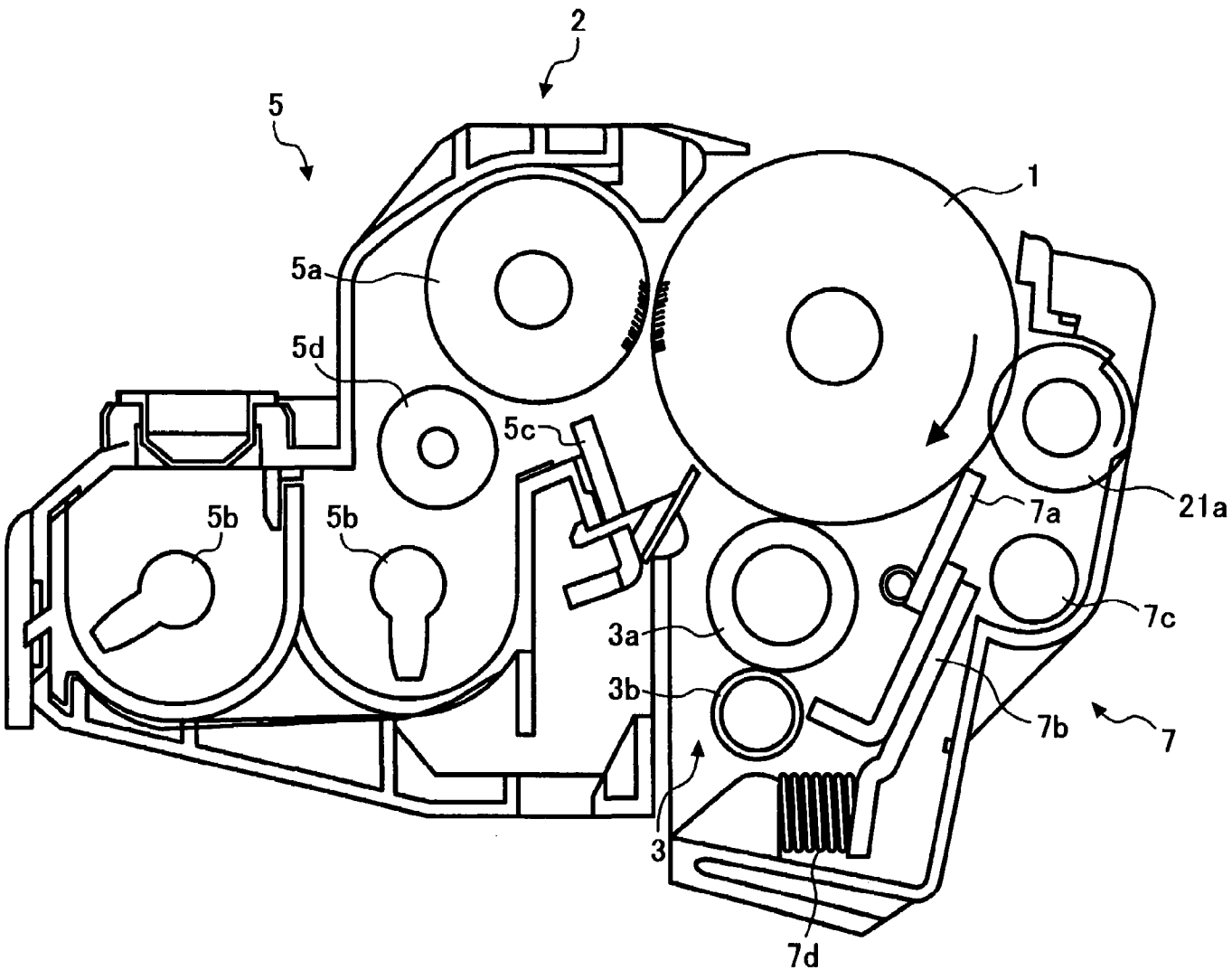
FIG. 2 is a schematic diagram illustrating an example of the process cartridge containing the image bearing member for use in the image forming apparatus of FIG. 1.

FIG. 2 is a schematic diagram illustrating an example of the structure of a process cartridge 2 provided to the image bearing member 1. The composition around each image bearing member of 1Y, 1C, 1M and 1K contained in respective process cartridges 2Y, 2C, 2M and 2K is all the same. Therefore the structure is illustrated only for the process cartridge 2 and the characters Y, C, M and K assigned to identify the four colors are omitted. Around the image bearing member 1, a developing device 5 for forming a toner image by visualizing a latent image formed on the image bearing member 1, a discharging device (not shown) for discharging the potential of the image bearing member 1 before cleaning, a fur brush 21*a* for preliminarily removing toner particles remaining on the image bearing member 1 as a supplementary device for a cleaning device 7 to relieve the burden of the cleaning blade 7*a* and to maintain the cleaning performance thereof, the cleaning device 7 for cleaning the surface of the image bearing member 1, and a charging device 3 for charging the image bearing member 1 are provided and arranged in this order along the surface moving direction of the image bearing member 1.

The structure of the image forming apparatus 100 of the present invention is now described based on FIGS. 1 and 2. The charging device 3 negatively charges the surface of the image bearing member 1. The charging device 3 of the present invention includes a charging roller 3*a* functioning as a charging member performing charging in a contact or proximity charging system. The charging roller 3*a* included in the charging device 3 is brought into contact with or arranged in the proximity of the surface of the image bearing member 1. The charging device 3 charges the surface of the image bearing member 1 by applying a direct current bias to the charging roller 3*a* such that the absolute value of the surface potential of the image bearing member 1 is from 200 to 700 V. In addition, a direct current bias with which an alternate current bias is overlapped can be also used. A cleaning roller 3*b* is provided in the charging device 3 to clean the surface of the charging roller 3*a*. This is to prevent poor charging such as non-uniform charging even when aslight amount of toner is attached to the charging roller 3*a*.

Also a thin film can be wound around the both end portions of the surface of the charging roller 3*a*. Thereby, a gap having a thickness corresponding to the thickness of the film is formed between the surface of the charging roller 3*a* and the surface of the image bearing member 1. Thereby, the frequency of contact between residual toner particles and the image bearing member 1 decreases.

Latent electrostatic images corresponding to each color are formed on the thus charged surface of each image bearing member 1 when an irradiation device 4 irradiates each image bearing member 1. The irradiation device 4 writes a latent electrostatic image corresponding to each color on the surface of the image bearing member 1 according to the image information corresponding to each color. The irradiation device 4 in this embodiment is an irradiation device adopting a laser beam system. Also other irradiation devices, for example, an irradiation device including LED arrays and an imaging device, can be utilized.

The developing device 5 contains a developing roller 5*a* functioning as a developer bearing member that partially extrudes from the opening in its casing, transfer rollers 5*b*, a doctor blade 5*c* and a scoop-up roller 5*d*. Supplied toner is transferred by the transfer roller 5*b* while being stirred with a carrier. The scoop-up roller 5*d* supplies the developer to the developing roller 5*a*. The doctor blade 5*c* controls the amount of the developer on the developing roller 5*a*. The developer used in this embodiment is a double component developer including a toner and a carrier as mentioned above. Also, a single component developer, which does not include a carrier, can be used. The toner is replenished from a toner bottle containing a corresponding color and the developing device 5 accommodates the toner in its interior. The developing roller 5*a* includes a magnet roller functioning as a magnetic field generator and a developing sleeve coaxially rotating around the magnetic roller. The carrier contained in the developer forms filaments on the developing roller. 5*a* by the magnetic force generated by the magnet roller and is transferred to the developing area, where the developing roller 5*a* faces the image bearing member 1. The surface of the developing roller 5*a* moves relatively fast in the development area compared with the surface of the image bearing member 1 while the surface of the developing roller 5*a* moves in the same direction as that of the surface of the image bearing member 1. The carrier filaments on the developing roller 5*a* supply toner attached to the surface thereof to the surface of the image bearing member 1 while the carrier filaments abrasively contact with the surface of the image bearing member 1. Thus, a latent electrostatic image is developed with the toner. At this point, a development bias of about 300 V is applied to the developing roller 5*a* from a power source (not shown) to form a development electric field in the development area.

The intermediate belt 6*a* included in a transfer device 6 is suspended over supporting rollers 6*b*, 6*c* and 6*d* and moves in the direction indicated by an arrow in FIG. 1 in an endless moving manner. Toner images on the image bearing members of 1Y, 1C, 1M and 1K are transferred onto the intermediate belt 6*a* in an overlapping manner by an electrostatic transfer system. There are several kinds of electrostatic transfer systems, for example, a structure including a transfer charging device. But, in this embodiment, a transfer roller 6*e* is adopted instead because the amount of dust produced at transferring is relatively small in the transfer roller system compared with that in the transfer charging system. In the transfer roller system, primary transfer rollers of 6*e*Y, 6*e*C, 6*e*M and 6*e*K included in the transfer device 6 are arranged such that the intermediate transfer belt 6*a* is sandwiched between the primary transfer rollers of 6*e*Y, 6*e*C, 6*e*M and 6*e*K and each image bearing member of 1Y, 1C, 1M and 1K, respectively. The portions of the intermediate transfer belt 6*a* that are pressed by the primary transfer rollers 6*e*Y, 6*e*C, 6*e*M and 6*e*K and the image bearing member 1 form a primary transfer area. When a toner image on each image bearing member of 1Y, 1C, 1M and 1K is transferred to the intermediate transfer belt 6*a*, a positive bias is applied to the primary transfer roller 6*e*Y, 6*e*C, 6*e*M and 6*e*K. Thereby, a transfer electric field is generated in each primary transfer area (hereinafter referred to as transfer area) and the toner image on each image bearing member of 1Y, 1C, 1M and 1K is electrostatically attracted and transferred to the intermediate belt 6*a*.

A belt cleaning device 6*f* is provided around the intermediate transfer belt 6*a* to remove toner particles remaining on the surface thereof. This belt cleaning device 6*f* has a structure in which a fur brush or a cleaning device 6*f* retrieves toner particles unnecessarily attached to the surface of the intermediate transfer belt 6*a*. The retrieved unnecessary toner particles are transferred from the belt cleaning device 6*f* to a waste toner tank (not shown) by a transfer medium (not shown). The intermediate transfer belt 6*a* is an endless single or multiple resin layer belt having a volume electric resistance of from $10^9$ to $10^{11}$ Ωcm.

A transfer conveyer device 9 for secondary transferring the toner image on the intermediate transfer belt 6*a* to a recording material is arranged on the right-hand side of FIG. 1. This transfer conveyer device 9 includes a transfer conveyer belt 9*a* and a secondary transfer roller 9*b*. The toner image overlapped on the intermediate transfer belt 6*a* is transferred to a recording material fed from a paper feeder unit 10. In the image forming apparatus 100 of the present invention, the toner image is transferred twice before a toner image is formed on a recording material. The transfer at the transfer device 9 is performed by applying a voltage having a reverse polarity to that of the toner to the transfer roller 9*b*. The secondary transfer area is formed between the intermediate transfer belt 6*a* and the secondary transfer roller 9*b*. A recording medium serving as a recording material is fed to this area at a predetermined timing. This recording medium is accommodated in the paper feeder unit 10 located beneath the irradiation device 4 and transferred to the secondary transfer area by a pickup roller (not shown), a pair of registration rollers 11, etc. The overlapped toner image on the intermediate transfer belt 6*a* is transferred to the recording medium on the transfer conveyer belt 9*a* at one time in the secondary transfer area. A positive bias is applied to the secondary transfer roller 9*b* at this secondary transfer to form a transfer electric field. Thereby the toner image on the intermediate transfer belt 6*a* is transferred to the recording medium.

The cleaning device 7 contains a cleaning blade 7*a*, a supporting member 7*b*, a toner retrieving coil 7*c* and a blade pressing spring 7*d*. The cleaning blade 7*a* removes toner particles remaining on the image bearing member 1 after transfer. The cleaning blade 7*a* is attached to the supporting member 7*b*. There is no limit on materials for the supporting member 7*b*. Specific examples of such materials include metals, plastics, ceramics, etc. Elastic substances having a low friction index can be used for the cleaning blade 7*a*. Specific examples of such elastic substances include urethane elastomers, silicone elastomers and fluorine elastomers among urethane resins, silicone resins and fluorine resins. Thermal curing urethane resins are preferred and urethane elastomers including rubber are particularly preferred in light of abrasion resistance, ozone resistance and contamination resistance. It is preferred that the cleaning blade 7 has a hardness of from 65 to 85 degree by JIS-A. It is also preferred that the cleaning blade 7*a* has a thickness of from 0.8 to 3.0 mm and an amount of extrusion of from 3 to 15 mm. Further, other conditions such as contact pressure, contact angle and allowable bearing amount can be suitably determined.

The toner for use in the image forming apparatus of the present invention can be prepared by manufacturing methods such as pulverization methods and polymerization methods (suspension polymerization, emulsion polymerization dispersion polymerization, emulsion agglomeration, emulsion association, etc.). An example of such pulverization methods is as follows: Fully mix the resin mentioned above, a dye as a colorant, a charge controlling agent, a release agent and other additives with a Henschel mixer; Knead the mixture with a kneader such as a batch type two rolls, a BANBURRY® mixer, a two axis extruder, a continuous type one axis kneader, etc.; Subsequent to cool rolling, the mixture is cut; the cut toner mixtures are subject to pulverization; Coarsely pulverize the toner mixtures with, for example, a hammer mill; Finely pulverize the coarsely pulverized resultant with a fine pulverizer using a jet air or a mechanical pulverizer; Classify the finlely pulverized resultant according to the predetermined granularity by a classifier using a whirling air stream or Coander effect; Thereafter, externally add particulate inorganic fine particles to the classified resultant with a mixer to obtain a toner. A polymerized toner is, for example, preferably prepared by cross-linking or elongating a toner constituent at least including a polyester prepolymer having a function group including a nitrogen atom, a polyester, a colorant, and a release agent in an aqueous medium under the presence of a particulate resin.

Further, it is possible to add particulates to the toner other than the particulate inorganic fine particles mentioned above. Specific examples of such particulates include silica, alumina, titanium oxide, barium titanate, magnesium titanate, calcium titanate, strontium titanate, zinc titanate, tin oxide, quarts sand, clay, mica, wollastonite, diatomous earth, chromic oxide, cerium oxide, colcothar, antimony trioxide, magnesium oxide, zirconium dioxide, barium sulfite, barium carbonate, calcium carbonate, silicon carbide, and silicon nitride. In addition, particulate polymers such as polystyrenes prepared by soap free emulsion polymerization, suspension polymerization, and dispersion polymerization and polycondensation particulate polymers and particulate thermal curing resins such as methacrylic acid esters, acrylic ester copolymers, silicone, benzoguanamine and nylon can be used. These external additives surface-treat toners so that a hydrophobic propery thereof can be improved and thus deterioration of fluidity and chargeability thereof can be prevented even under a high humidity condition. Specific preferred examples of such surface treatment agents include silane coupling agents, silyation agents, silane coupling agents having a fluorine alkyl group, organic titanate containing coupling agents, coupling agents containing aluminium, silicone oils, and modified silicone oils. Hydrophobic silica and hydrophobic titan oxide that are prepared through the surface treating of silica and titan oxide, respectively, are particularly preferred.

It is preferred to use a particulate having a primary particle diameter of from 8 to 300 nm and more preferred to use a mixture of an external additive having a particle diameter of from 8 to 50 nm and another external additive having a particle diameter of from 8 to 50 nm. The ratio of the particulate is preferably from 0.01 to 5% by weight to a toner and more preferably from 0.1 to 2.0% by weight.

The particulate can be contained by putting the particulate and mother particles of a toner in a mixer and stirring the particulate and the mother particles of the toner therewith. The particulate can be externally added to toner particles in an aqueous and/or alcohol medium. An external additive is thrown in a toner dispersed in an aqueous medium to be attached to the surface of the toner particles. When an external additive has been hydrophobically treated, it is suitable to reduce surface tension thereof by adding a small quantity of alcohol before dispersion. Thereafter, the solution is heated to fix the external additive, thereby preventing detachment thereof. The external additive can be thus dispersed on the surface of the toner particles uniformly. In addition, when a toner and an external additive are dispersed, the external additive can be more uniformly dispersed on the surface of the toner by adding a surface active agent. Further, it is preferred to use a surface active agent having a reverse polarity to that of the external additive or that of the toner.

In the image forming apparatus 100 of the present invention, the toner for use therein preferably has a weight average particle diameter Dm of from 4.0 to 8.0 μm and the circumference velocity of the image forming apparatus 100 is preferably from 150 to 600 mm/sec. In these ranges, the weight average particle diameter Dm and the circumference velocity satisfies the following relationship: $4.0^3/6.00$ (=0.10)< or $=Dm^3/V<$ or $=8.0^3/150$(=3.41). When the weight average particle diameter of the toner is in the range of from 4.0 to 8.0 μm, as the toner particle diameter decreases, the reproducibility of fine lines is improved and high quality images can be obtained. When the volume average particle diameter of the toner is too small, its cleaning performance may deteriorate and it is difficult to reduce cost because energy is required for pulverization, etc. When the volume average particle diameter of the toner is too large, its cleaning performance is good but it is difficult to obtain high quality images. With regard to the particle size distribution, the ratio (Dv/Dn) of the volume average particle diameter (Dv) to the number average particle diameter (Dn) is from 1.05 to 1.40. By narrowing the particle size distribution, the distribution of the amount of charge can be uniform so that quality images can be obtained with less background development and the transferability can be improved. When the ratio (Dv/Dn) thereof is too small, manufacturing such a toner is difficult. When the ratio (Dv/Dn) thereof is too large, it is difficult to obtain quality images because the distribution of the amount of charge is wide.

In addition, it is preferred that the circumference velocity V of the image bearing member 1 is from 150 to 600 mm/sec. When the circumference velocity V of the image bearing member 1 is too low, it is not necessary to determine the particle diameter of a toner, process conditions, etc. because the speed of remaining toner particles is not high, resulting in good cleaning performance. When the circumference velocity V of the image bearing member 1 is too high, the contact pressure between the image bearing member 1 and the cleaning blade 7*a* is necessary to be raised. However, when the contact pressure is high, the cleaning blade tends to be curled up, resulting in poor cleaning performance. With regard to removing toner particles on the image bearing member 1, the weight average particle diameter Dm (μm) of the toner and the circumference velocity V of the image bearing member 1 affect greatly. As mentioned above, the weight average particle diameter Dm (μm) and the circumference velocity V satisfy the following relationship: 0.10< or =$Dm^3/V$<3.41. As the weight particle diameter Dm of a toner decreases, the cleaning property of the toner degrades. As the circumference velocity V of the image bearing member 1 reduces, the cleaning property of the toner improves. The weight average particle diameter Dm and the circumference velocity V of the image bearing member 1 are in reverse proportion to with regard to cleaning property of a toner. Therefore, when the contact pressure between the image bearing member 1 and the cleaning blade 7*a* is raised to improve cleaning performance under the condition that when $Dm^3/V$ is too low, the cleaning blade 7*a* tends to curl up, resulting in poor cleaning performance. Cleanability of a toner can be improved by, for example increasing the weight average particle diameter of the toner in this case. When $Dm^3/V$ is too high, it means that the toner particle diameter is large, resulting in deterioration of image quality and that the circumference velocity of the image bearing member 1 is slow, meaning that such an image forming apparatus is not suitable for a practical use.

Further, for the image forming apparatus 100 of the present invention, the following relationship (2) is satisfied: (2) $T_{ave.}$< or =1.40 kgf·cm, wherein $T_{ave.}$ represents an average of a torque T (kgf·cm) of the image bearing member for 15 seconds while the image bearing member 1 is in contact with the cleaning blade 7*a*.

Figure 3:
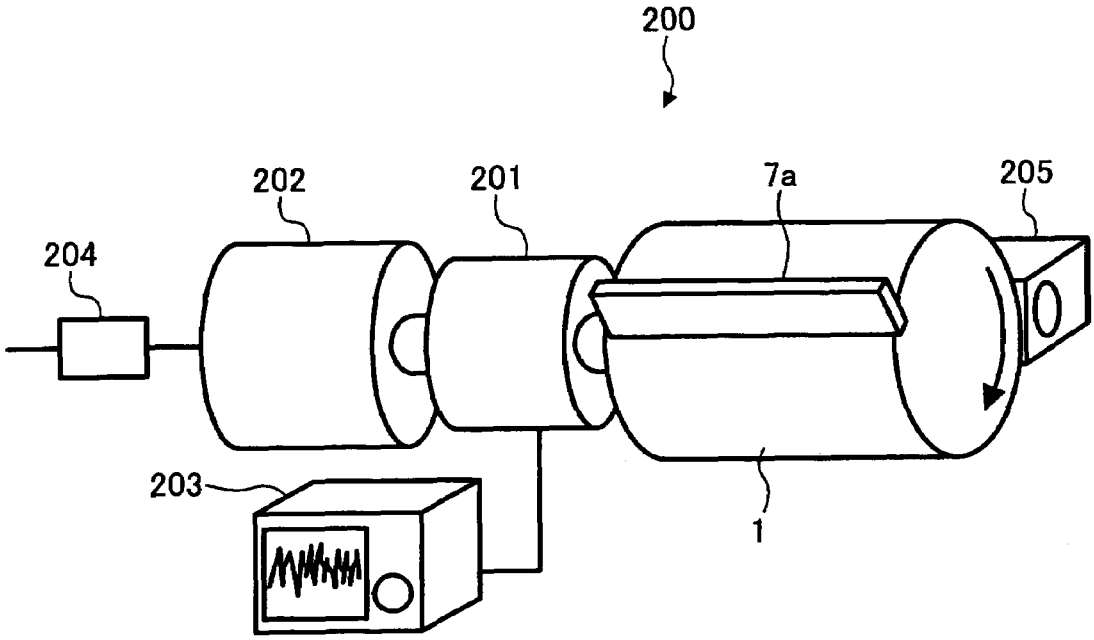
FIG. 3 is a schematic diagram illustrating a torque measuring device.

FIG. 3 is a schematic diagram illustrating the structure of a torque measuring device 200 that measures a torque of the image bearing member 1 while the cleaning blade 7*a* is in contact with the image bearing member 1. The torque measuring device 200 includes a torque sensor 201 attached to a driving axis for driving the image bearing member 1, a motor 202 for driving the driving axis, a recorder 203 for recording torque T measured by the torque sensor 201, a power source 204 for driving the motor 202, and a control device 205 for controlling these elements. In FIG. 3, the cleaning blade 7*a* and the developing roller 5*a* are provided around the image bearing member 1. The other members contacting the image bearing member 1 such as the charging roller 3*a* and the respective of the transfer roller 6*e*Y, 6*e*C, 6*e*M and 6*e*K can be also provided therearound.

The image forming apparatus 100 of the present invention satisfies the relationship, $T_{ave.}$< or =1.40 kgf·cm, by using the torque measuring device 200. When the cleaning blade 7*a* is brought into contact with the image bearing member 1, the torque T becomes large because this contact works as a burden to the driving axis. When $T_{ave.}$ is too large, the burden to the image bearing member 1 becomes too large, resulting in stick slip movement of the image bearing member 1. It is inferred that this leads to an increase of the amount of toner evading the cleaning blade 7*a*, resulting in poor cleaning performance. As long as $T_{ave.}$ is not greater than 1.40 kgf·cm, poor cleaning performance can be prevented even when the environment conditions and contact conditions change.

Figure 4:
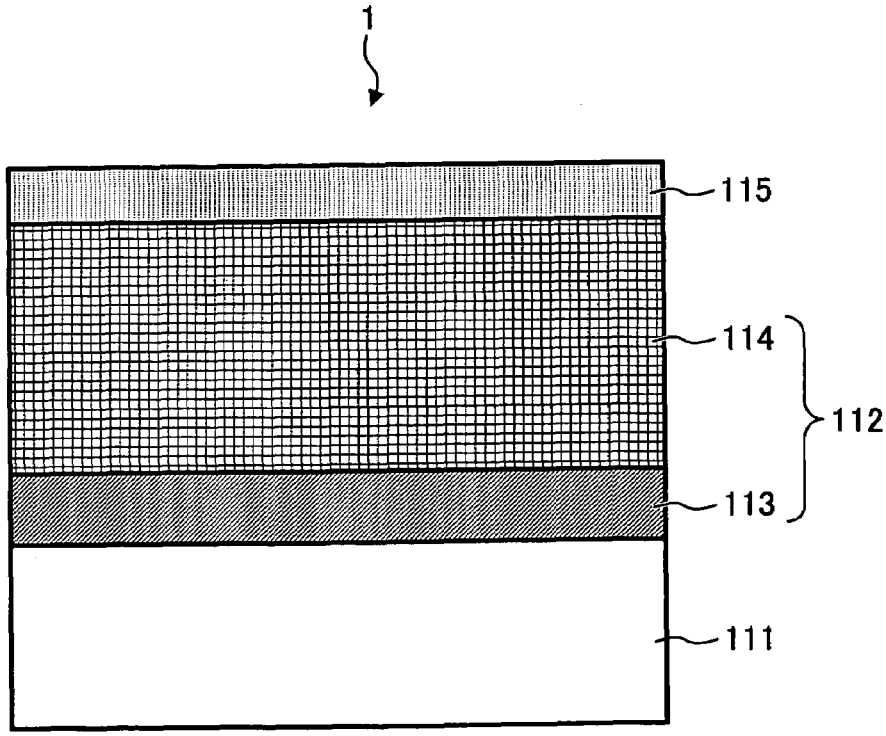
FIG. 4 is a schematic diagram illustrating the layer structure of an image bearing member for use in the image forming apparatus of FIG. 1.

FIG. 4 is a schematic cross section illustrating the structure of the image bearing member 1 of the image forming apparatus 100 of the present invention. A photosensitive layer 112 including a charge generating layer 113 mainly formed of a charge generating material and a charge transport layer 114 mainly formed of a charge transport material is formed on an electroconductive substrate 111. In the present invention, a protective layer 115 is formed on the photosensitive layer 112 as an outermost layer of the image bearing member 1. Thereby friction between the image bearing member 1 and the cleaning blade 7*a* can be reduced. The friction index of the surface of the image bearing member 1 can be decreased by providing the protective layer 115 as the outermost layer containing a particulate fluorine resin functioning as a solid lubricant in an amount of from 20 to 60% by volume. It is also possible to apply a solid lubricant such as zinc stearate to the surface of the image bearing member 1 for friction adjustment. Specific examples of such solid lubricants include metal salts of aliphatic acid such as lead oleate, zinc oleate, copper oleate, zinc stearate, cobalt stearate, iron stearate, copper stearate, zinc palmiatate, copper palmitate and zinc linolenate, and fluorine containing particulate resins such as polytetra fluoroethylene, polychloro trifluoroethylene, polyfluoro vinyliden, polytrifluoro chloroethylene, dichloro difluoroethylene, tetrafluorothylene-ethylene copolymers and tetrafluoroethylene-oxyafluoroporopylene copolymers. Especially among these fluorine containing particulate resins, it is preferred to contain polyfluorovinyliden and polytetrafluoroethylene having a low molecular weight. The low molecular weight for a fluorine containing particulate resin is in a range not greater than several hundreds of thousands. These fluorine containing particulate resins are manufactured such that the average molecular weight thereof is restrained to be small by controlling their molecular weight using a polymerization method, radiolysis method, thermal decomposition method or the like. Also, the function of a lubricant is exhibited by restraining the average molecular weight to be low. In addition, these fluorine containing particulate resins are a non-polar polymer having an extremely high symmetry property and thus their intermolecular agglomeration force is extremely small. In addition, the surface of molecular chains is extremely smooth. Thereby, the friction index of a fluorine containing particulate resin having a low molecular weight is low.

The protective layer 115 containing a fluorine containing particulate resin as a lubricant is formed on the photosensitive layer 112 to protect the photosensitive layer 112 and to improve the abrasion resistance thereof. The amount of the fluorine containing particulate resin added to the protective layer 115 is from 20 to 60% by volume. When the amount thereof is too small, the obtained friction index is not sufficient. When the amount thereof is too large, it is not preferred because a decrease in the sensitivity and an increase of the remaining potential are not ignorable and further the mechanical strength of a coated film decreases. When the particle diameter of the fluorine containing particulate resin is too large, irradiation light is scattered at the protective layer 115. Thereby resolution ability lessens and image quality deteriorates. When the particle diameter of the fluorine containing particulate resin thereof is too small, abrasion resistance of the protective layer 115 is inferior. Therefore, the particle diameter of the fluorine containing particulate resin added to the protective layer 115 is suitably from 0.1 to 0.3 μm. The protective layer 115 is formed by dispersing a fluorine containing particulate resin and a binder resin in a suitable solvent and spray coating the dispersion liquid. Specific examples of the binder resins and solvents for use in forming the protective layer 115 include the same materials as those for use in the charge transport layer 114 mentioned later. The thickness of the protective layer 115 is preferably from 0.1 to 10 μm. It is possible to add a charge transport material, an oxidation inhibitor, etc., to the protective layer 115. The abrasion resistance of the image bearing member 1 also can be improved by providing the protective layer 115 containing a fluorine containing particulate resin. Further, when a toner having a small particle diameter is used and the contact pressure of the cleaning blade 7*a* is high, cleaning can be performed without excessively abrading the surface of the image bearing member 1. In addition, when the abrasion resistance of the image bearing member 1 is improved, the amount of applying a lubricant can be reduced and thus the life of the lubricant increases.

In addition, the image forming apparatus 100 has a contact member for abrading the fluorine containing particulate resin in the protective layer of the image bearing member 1. The cleaning blade 7*a* can also serve as this contacting member. The fluorine containing particulate resin exposed on the surface of the protective layer of the image bearing member 1 is extended and flattened by abrasion with the contact member or the cleaning blade 7*a* and thus a thin layer of the fluorine containing particulate resin is formed on the surface of the image bearing member 1. The fluorine containing particulate resin is a lubricant and thereby the friction index of the surface of the image bearing member 1 decreases. As a result, the increase in the torque generated between the image bearing member 1 and the cleaning blade 7*a* can be restrained.

In addition, a charge transport material can be contained in the protective layer 115. Among these charge transport materials having a low molecular weight, there are electron transport materials and positive hole transport materials. Specific examples of electron transport materials include chloroanil, bromoanil, tetracyanoethylene, tetracyanoquinodimethane, 2,4,7-trinitro-9-fluorenone, 2,4,5,7-tetranitro-9-fluorenone, and 1,3,7-trinitrodibenzothiophen-5,5-dioxide. Specific examples of positive hole transport materials include oxazole derivatives, oxadiazole derivatives, imidazole derivatives, triphenylamine derivatives, phenylhydrazones, α-phenylstilbene derivatives, thiazole derivatives, triazole derivatives, phenazine derivatives, acridine derivatives and thiophene derivatives. A decrease in photosensitivity of the image bearing member 1 caused by employing a fluorine containing particulate resin in the protective layer 115 can be prevented by containing the charge transport layer therein. The content ratio of such a charge transport material is 20 to 300% by weight to 100 parts of a binder resin. When the ratio is too small, the sensitivity of the image bearing member 1 deteriorates. When the ratio is too large, the mechanical strength of the coated film deteriorates.

In the image bearing member 1, the electroconductive substrate 111 used therein is a material having a volume resistance not greater than $10^{10}$ Ωcm, for example a metal such as aluminum and stainless metal processed to have a tube form or a metal such as nickel processed to have an endless form. The charge generation layer 113 is a layer mainly containing a charge generation material. Specific examples of such charge generation materials include monoazo dye, disazo dyes, trisazo dyes, and phthalocyanine dyes. These charge generation materials are dispersed with a binder resin such as a polycarbonate in a solvent such as tetrahydrofuran and cyclohexanone to obtain a dispersion liquid. The charge generation layer 113 can be formed by coating of the dispersion. The coating is performed by dip coating methods, spray coating methods, etc. The thickness of the charge generation layer 113 is from 0.01 to 5 μm and preferably from 0.1 to 2 μm. A charge transport material and a binder resin are dissolved or dispersed in a suitable solvent such as tetrahydrofuran, toluene and dichloroethane and the obtained dissolved solution or dispersed liquid is coated and dried to form the charge transport layer 114. In addition, a plasticizer and a leveling agent can be added if necessary.

Specific examples of such binder resins for use together with the charge transport material in the charge transport layer 114 include thermal plastic resins or thermal curing resins such as polystyrene resins, styrene-acrylonitrile copolymers, styrene-butadiene copolymers, polyester resins, polyarylate resins, polycarbonate resins, acryl resins, epoxy resins, melamine resins, phenol resins. The thickness of the charge transport layer 114 can be selected from the range of from 5 to 30 μm according to desired characteristics of the image bearing member 1.

For the charge transport layer, a charge transport polymer that can serve as a charge transport material and a binder resin can be preferably used. Materials known as charge transport materials can be used. Particularly, polycarbonates having triaryl amine structure in its main chain or branch chain can be preferably used. Among these, the charge transport material having the following chemical formulae can be suitably used.

[Chemica formula 1]

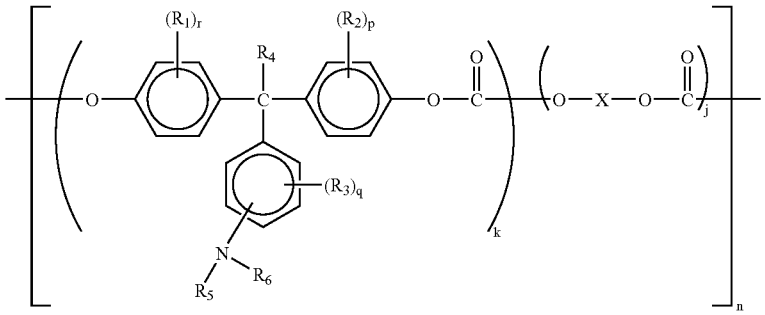

(1)

In chemical formula 1, $R_1$, $R_2$ and $R_3$ are independently a substituted or unsubstituted alkyl group or a halogen atom, $R_4$ represents a hydrogen atom or a substituted or unsubstituted alkyl group, $R_5$ and $R_6$ represent a substituted or unsubstituted aryl group, p, q and r represent 0 or an integer of from 1 to 4, k and j represent a composition, wherein k satisfies the following relationship: 0.1< or =k< or =1, and j satisfies the following relationship: 0< or =j< or =0.9, and n represents the number of repeats and an integer of from 5 to 5000. Character X represents a divalent group of an aliphatic series or cyclic aliphatic series, or a divalent group represented by the following formula.

[Chemical formula 2]

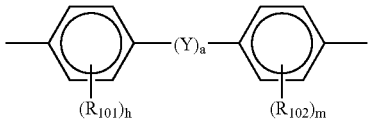

(2)

In chemical formula 2, $R_{101}$ and $R_{102}$ are independently a substituted or unsubstituted alkyl or aryl group or a halogen atom and m and h represent 0 or an integer of from 1 to 4. A character Y represents a straight, branched or cyclic alkylene group having 1 to 12 carbon atoms, wherein a is 0 or 1, —O—, —S—, —SO—, $SO_2$—, —CO—, and —CO—O-Z-O—CO—, wherein z represents a divalent group of aliphatic series. Or X represents the following chemical formula 3.

[Chemical formula 3]

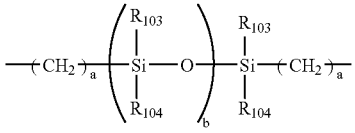

(3)

In chemical formula 3, character a represents an integer of from 1 to 20, b represents an integer of from 1 to 2000, and $R_{103}$ and $R_{104}$ represent a substituted or unsubstituted alkyl or aryl group). Characters $R_{101}$, $R_{102}$, $R_{103}$ and $R_{104}$ can be the same or different from each other.

[Chemical formula 4]

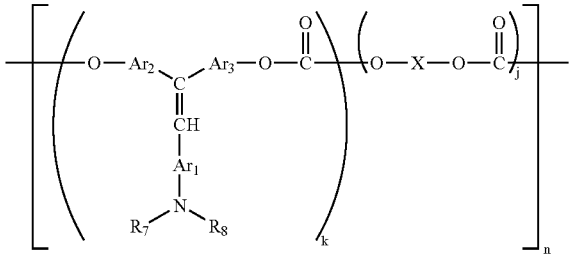

(4)

In chemical formula 4, $R_7$ and $R_8$ represent a substituted or unsubstituted aryl group. Characters $Ar_1$, $Ar_2$ and $Ar_3$ independently represent an allylene group. Characters X, k, j and n represent the same as those in chemical formula 1.

[Chemical formula 5]

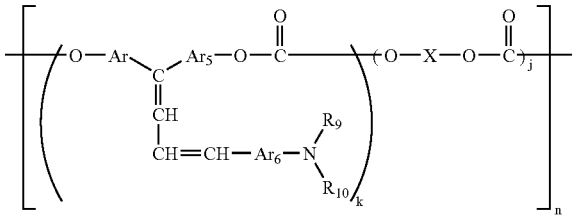

(5)

In chemical formula 5, $R_9$ and $R_{10}$ represent a substituted or unsubstituted aryl group. Characters $Ar_4$, $Ar_5$ and $Ar_6$ independently represent an allylene group. Characters X, k, j and n represent the same as those in chemical formula 1.

[Chemical formula 6]

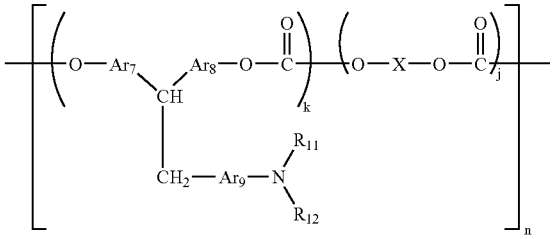

(6)

In chemical formula 6, $R_{11}$ and $R_{12}$ represent a substituted or unsubstituted aryl group. Characters $Ar_7$, $Ar_8$ and $Ar_9$ independently represent an allylene group. Characters X, k, j and n represent the same as those in chemical formula 1.

[Chemical formula 7]

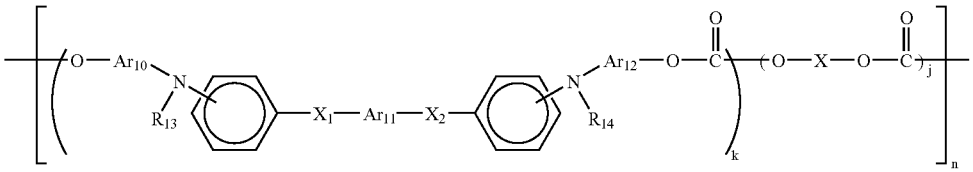

(7)

In chemical formula 7, $R_{13}$ and $R_{14}$ represent a substituted or unsubstituted aryl group. Characters $Ar_{10}$, $Ar_{11}$ and $Ar_{12}$ independently represent an allylene group. Characters $X_1$ and $X_2$ represent a substituted or unsubstituted ethylene group or a substituted or unsubstituted vinylene group. Characters X, k, j and n represent the same as those in chemical formula 1.

[Chemical formula 8]

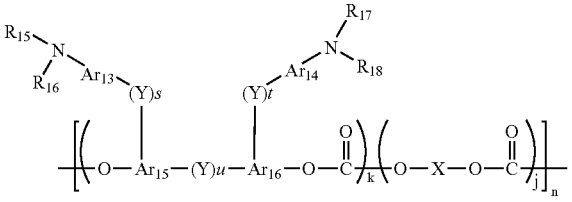

(8)

In chemical formula 8, $R_{15}$, $R_{16}$, $R_{17}$ and $R_{18}$ represent a substituted or unsubstituted aryl group and $Ar_{13}$, $Ar_{14}$, $Ar_{15}$ and $Ar_{16}$ independently represent an allylene group. Characters (Y)s, (Y)t and (Y)u independently represent a substituted or unsubstituted alkylene, a substituted or unsubstituted cycloalkylene, a substituted or unsubstituted alkylene ether group, an oxygen atom, a sulfur atom and a vinylene group, wherein s, t and u independently are 0 or 1. Characters X, k, j and n represent the same as those in chemical formula 1.

[Chemical formula 9]

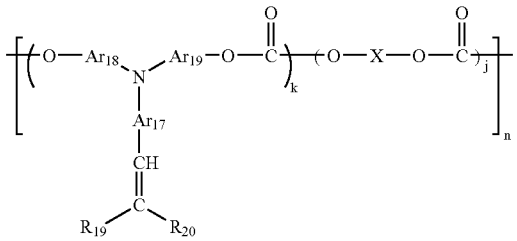

(9)

In chemical formula 9, $R_{19}$ and $R_{20}$ represent a hydrogen atom or a substituted or unsubstituted aryl group and can have a cyclic form. Characters $Ar_{17}$, $Ar_{18}$ and $Ar_{19}$ independently represent an allylene group. Characters X, k, j and n represent the same as those in chemical formula 1.

[Chemical formula 10]

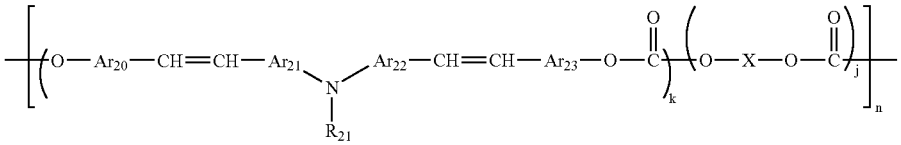

(10)

In chemical formula 10, $R_{21}$ represents a substituted or unsubstituted aryl group and $Ar_{20}$, $Ar_{21}$, $Ar_{22}$ and $Ar_{23}$ independently represent an allylene group. Characters X, k, j and n represent the same as those in chemical formula 1.

[Chemical formula 11]

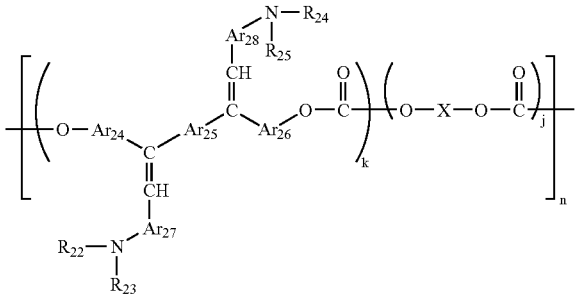

(11)

In chemical formula 11, $R_{22}$, $R_{23}$, $R_{24}$ and $R_{25}$ represent a substituted or unsubstituted aryl group and $Ar_{24}$, $Ar_{25}$, $Ar_{26}$, $Ar_{27}$ and $Ar_{28}$ independently represent an allylene group. Characters X, k, j and n represent the same as those in chemical formula 1.

[General formula 12]

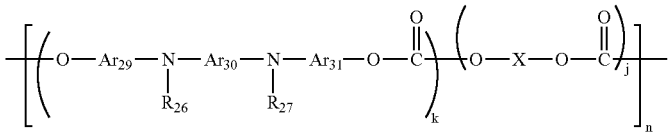

(12)

In chemical formula 12, $R_{26}$ and $R_{27}$ represent a substituted or unsubstituted aryl group and $Ar_{29}$, $Ar_{30}$ and $Ar_{31}$ independently represent an allylene group. Characters X, k, j and n represent the same as those in chemical formula 1.

The image bearing member 1 can have an undercoat layer between the electroconductive substrate 111 and the photosensitive layer 112. In general, such an undercoat layer is mainly made of a resin. Considering that the photosensitive layer 112 is coated on the resin by using a solvent, it is preferred that the resin is hardly soluble to common solvents. Specific examples of such resins include water-soluble resin such as polyvinyl alcohol resins, alcohol-soluble resins such as copolymer nylons and curing type resins having a three-dimensional mesh structure such as polyurethane resins, alkyd-melamine resins and epoxy resins. In addition, the undercoat layer mentioned above can contain fine powder of a metal oxide such as titanium oxide, silica and alumina to prevent moiré, to decrease residual potential, etc. The undercoat layer can be formed by using a soluble solvent and a coating method mentioned above for those for the photosensitive layer 112. A suitable thickness of the undercoat layer is from 0.1 to 5 μm.

In addition, the circularity of the toner used is not less than 0.93. When a toner is prepared by a dry pulverization method, the pulverized toner is subject to a thermal or mechanical conglobation treatment. In the thermal conglobation treatment, toner particles are sprayed to a heated air flow by an atomizer. In the mechanical conglobation treatment, toner particles are thrown in a mixer such as a ball mill together with a mixture medium such as glass having a light specific gravity and stirred. However, in the thermal conglobation treatment, toner particles tend to agglomerate and form toner particles having a large particle diameter, and in the mechanical conglobation treatment, fine toner particles tend to be produced. Therefore, another classification process is required after the conglobation treatment. In the case of a toner prepared in an aqueous medium, its form can be controlled by performing vigorous stir-up in the process of removing the solvent. The circularity of toner particles is defined by the following relationship: Circularity SR=(the circumferential length of the circle having the area equal to a projected toner area/the circumferential length of the projected toner area). The SR value is close to 1.00 as a toner particle gets closer to a true sphere. When toners having a high circularity are on carriers or a developing sleeve, such toners tend to be affected by lines of electric force and thus the toner is transferred exactly along the lines of electric force of a latent electrostatic image. When fine latent dots are reproduced, the toners are densely and uniformly arranged and the amount of dust is less between the lines so that fine line reproducibility becomes excellent. When toners have too small a circularity, the quality of images obtained is low, especially reproducibility of fine lines tends to degrade and thus reproducing fine images is difficult.

Figure 5A:
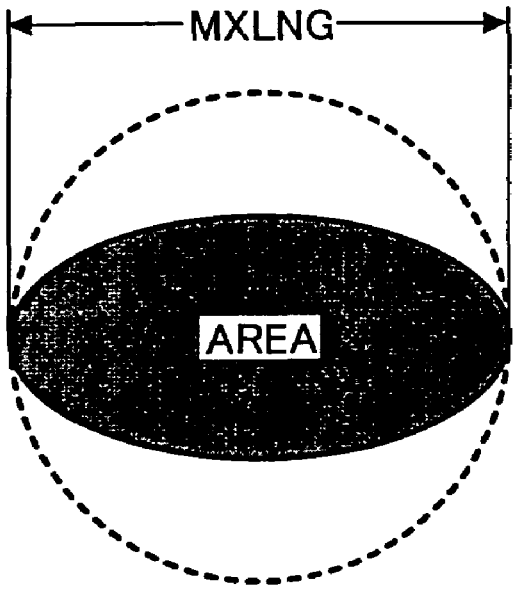
FIGS. 5A and 5B are schematic diagrams for explaining the form factors SF-1 and SF-2 of toner particles.
Figure 5B:
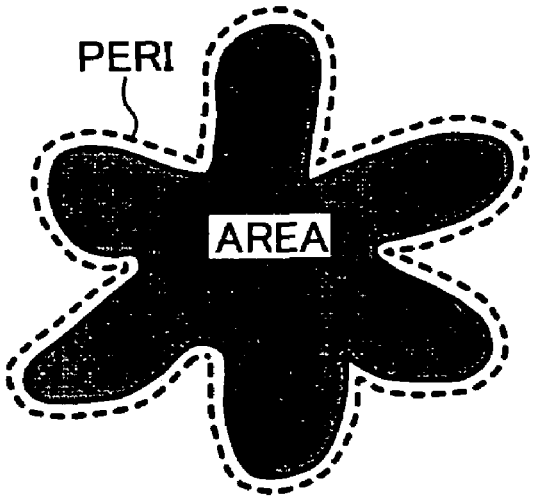

Further, it is preferred that the circularity of the toner for use in the developing device 5 can be defined by the following form factors SF-1 and SF-2. FIGS. 5A and 5B are schematic diagrams for explaining the form factors SF-1 and SF-2, respectively. As illustrated in FIG. 5A, the form factor SF-1 represents the degree of roundness of a toner particle and is defined by the following equation (3):

$$SF\text{-}1=\{(MXLNG)^2/(\mathrm{AREA})\}\times(100\pi/4) \quad (3)$$

Wherein, MXLNG represents a diameter of the circle circumscribing the image of a toner particle obtained, for example by observing the toner particle with a microscope, and AREA represents the area of the image.

When the SF-1 is 100, the toner particle is a true sphere. It can be said that as SF-1 increases, the toner form differs away from a true sphere form.

As illustrated in FIG. 5B, the form factor SF-2 represents the degree of concavity and convexity of a toner particle and is defined by the following equation (4):

$$SF\text{-}2=\{(\mathrm{PERI})^2/(\mathrm{AREA})\}\times(100/4\pi) \quad (4)$$

Wherein, PERI represents the peripheral length, or perimeter, of the image of a toner particle observed, for example by a microscope; and AREA represents the area of the image.

When the SF-2 is 100, the surface of the toner particle does not have any concavity or convexity. It can be said that as SF-2 increases, the toner surface becomes rough.

The form factors SF-1 and SF-2 are determined by the following method:

(1) Take photographs of 100 toner particles using a scanning electron microscope (S-800, manufactured by Hitachi Ltd.) with a magnifying power of 1,000;
(2) Analyze the particle images obtained using an image analyzer (LUSEX 3 manufactured by Nireco Corp.); and
(3) Calculate the average of the results.

The toner of the present invention has a form factor SF-1 of from 100 to 180 and a form factor SF-2 of from 100 to 180. When the toner has a form close to a true sphere, the contact between toner particles and between toner particles and the image bearing member 1 becomes a point to point contact. Thereby the adhesion force between the toner particles weakens, and therefore the toner has a good fluidity. In addition, the adhesion force between the toner particles and the image bearing member 1 is also weak and the transfer rate of the toner is high. On the other hand, toner particles having a true sphere form are easy to sneak through the gap between the cleaning blade 7*a* and the photoreceptor 1. Therefore it is preferred that the form factors SF-1 and SF-2 are large in some degree. However, when these form factors are too large, toner particles scatter on an image, resulting in degradation of the quality thereof. It is thus preferred that the form factors of SF-1 and SF-2 are not larger than 180.

Suitable toners for use in the image forming apparatus 100 of the present invention are prepared by dissolving or dispersing toner materials at least containing a polymer having a portion reactive with a compound having an active hydrogen group, a polyester, a colorant, and a release agent in an organic solvent to obtain a toner material liquid. Thereafter the toner material liquid is subject to cross-bridging and/or elongating reaction in an aqueous medium to obtain a toner. The toner component materials and the manufacturing methods are now described.

(Modified Polyester)

The toner of the present invention includes a binder resin containing a modified polyester (i) which is a polymer. The unmodified polyester (i) represents what contains a bond group other than ester linkage in a polyester resin, or is in a state in which a resin component in the polyester resin is bonded with another resin component having a different structure therefrom by a covalent linkage or an ionic linkage. Such unmodified polyesters are prepared by introducing a function group such as an isocyanate group that is reactive with a carboxylic group and a hydroxyl group at the end of a polyester and modifying the end of the polyester by reacting the resultant with a compound having an active hydrogen.

Specific examples of such modified polyesters (i) include urea modified polyesters prepared by reaction between a polyester prepolymer (A) having an isocyanate group and an amine (B). Specific examples of such polyester prepolymers (A) having an isocyanate group include a polycondensation compound of a polyol (PO) and polycarboxylic acid (PC) in which the polyester having an active hydrogen group further reacts with a polyisocyanate compound (PIC). Specific examples of such active hydrogen groups contained in the polyester mentioned above include hydroxyl group (alcoholic hydroxyl group and phenolic hydroxyl group), amino group, carboxyl group and mercapto group. Among these, alcoholic hydroxyl group is preferred.

Urea modified polyesters are prepared as follows.

The polyols (PO) mentioned above are diols (DIO) and polyols (TO) having three or more hydric groups. It is preferred to use a diol (DIO) alone or a mixture in which a small amount of a polyol (TO) is added to a diol (DIO). Specific examples of diols (DIO) include alkylene glycol (e.g., ethylene glycol, 1,2-propylene glycol, 1,3-propylene glycol, 1,4-butanediol and 1,6-hexanediol); alkylene ether glycols (e.g., diethylene glycol, triethylene glycol, dipropylene glycol, polyethylene glycol, polypropylene glycol and polytetramethylene ether glycol); alicyclic diols (e.g., 1,4-cyclohexane dimethanol and hydrogenated bisphenol A); bisphenols (e.g., bisphenol A, bisphenol F and bisphenol S); adducts of the alicyclic diols mentioned above with an alkylene oxide (e.g., ethylene oxide, propylene oxide and butylene oxide); adducts of the bisphenols mentioned above with an alkylene oxide (e.g., ethylene oxide, propylene oxide and butylene oxide); etc. Among these compounds, alkylene glycols having from 2 to 12 carbon atoms and adducts of bisphenols with an alkylene oxide are preferable. More preferably, adducts of bisphenols with an alkylene oxide, or mixtures of an adduct of bisphenols with an alkylene oxide and an alkylene glycol having from 2 to 12 carbon atoms, are used. Specific examples of the polyols (TO) include aliphatic alcohols having three or more hydroxyl groups (e.g., glycerin, trimethylol ethane, trimethylol propane, pentaerythritol and sorbitol); polyphenols having three or more hydroxyl groups (trisphenol PA, phenol novolak and cresol novolak); adducts of the polyphenols mentioned above with an alkylene oxide; etc.

Suitable polycarboxylic acids (PC) include dicarboxylic acids (DIC) and polycarboxylic acids (TC) having three or more carboxyl groups. It is preferred to use dicarboxylic acids (DIC) alone or mixtures in which a small amount of a polycarboxylic acid (TC) is added to a dicarboxylic acid (DIC).

Specific examples of the dicarboxylic acids (DIC) include alkylene dicarboxylic acids (e.g., succinic acid, adipic acid and sebacic acid); alkenylene dicarboxylic acids (e.g., maleic acid and fumaric acid); aromatic dicarboxylic acids (e.g., phthalic acid, isophthalic acid, terephthalic acid and naphthalene dicarboxylic acids; etc. Among these compounds, alkenylene dicarboxylic acids having from 4 to 20 carbon atoms and aromatic dicarboxylic acids having from 8 to 20 carbon atoms are preferably used.

Specific examples of the polycarboxylic acids (TC) having three or more hydroxyl groups include aromatic polycarboxylic acids having from 9 to 20 carbon atoms (e.g., trimellitic acid and pyromellitic acid).

As the polycarboxylic acid (PC), anhydrides or lower alkyl esters (e.g., methyl esters, ethyl esters or isopropyl esters) of the polycarboxylic acids mentioned above can be used for the reaction with a polyol (PO).

A suitable mixing ratio (i.e., an equivalence ratio [OH]/[COOH]) of a polyol (PO) to a polycarboxylic acid (PC) ranges from 2/1 to 1/1, preferably from 1.5/1 to 1/1, and more preferably from 1.3/1 to 1.02/1.

Specific examples of the polyisocyanates (PIC) include aliphatic polyisocyanates (e.g., tetramethylene diisocyanate, hexamethylene diisocyanate and 2,6-diisocyanate methylcaproate); alicyclic polyisocyanates (e.g., isophorone diisocyanate and cyclohexylmethane diisocyanate); aromatic diisocyanates (e.g., tolylene diisocyanate and diphenylmethane diisocyanate); aromatic aliphatic diisocyanates (e.g., α, α, α', α'-tetramethyl xylylene diisocyanate); isocyanurates; blocked polyisocyanates in which the polyisocyanates mentioned above are blocked with phenol derivatives, oximes or caprolactams; etc. These compounds can be used alone or in combination.

A suitable mixing ratio (i.e., [NCO]/[OH]) of a polyisocyanate (PIC) to a polyester having a hydroxyl group varies from 5/1 to 1/1, preferably from 4/1 to 1.2/1 and more preferably from 2.5/1 to 1.5/1. When the [NCO]/[OH] ratio is too large, the low temperature fixability of the toner deteriorates. In contrast, when the ratio is too small, the content of the urea group in the modified polyesters decreases, thereby deteriorating the hot-offset resistance of the toner.

The content of the constitutional component of a polyisocyanate (PIC) in the polyester prepolymer (A) having an isocyanate group at its end portion ranges from 0.5 to 40% by weight, preferably from 1 to 30% by weight, and more preferably from 2 to 20% by weight. When the content is too low, the hot offset resistance of the toner deteriorates and in addition the heat resistance and low temperature fixability of the toner also deteriorate. In contrast, when the content is too high, the fixability of the toner at a low temperature deteriorates.

The number of the isocyanate groups included in a molecule of the polyester prepolymer (A) is at least 1, preferably from 1.5 to 3 on average, and more preferably from 1.8 to 2.5 on average. When the number of the isocyanate group is too small (less than 1 per 1 molecule), the molecular weight of the resultant urea-modified polyester decreases and thereby the hot offset resistance deteriorates.

Specific examples of the amines (B), which are to react with a polyester prepolymer (A), include diamines (B1), polyamines (B2) having three or more amino groups, amino alcohols (B3), amino mercaptans (B4), amino acids (B5), and blocked amines (B6) in which the amines (B1–B5) mentioned above are blocked.

Specific examples of the diamines (B1) include aromatic diamines (e.g., phenylene diamine, diethyltoluene diamine and 4,4'-diaminodiphenyl methane); alicyclic diamines (e.g., 4,4'-diamino-3,3'-dimethyldicyclohexyl methane, diaminocyclohexane and isophoron diamine); aliphatic diamines (e.g., ethylene diamine, tetramethylene diamine and hexamethylene diamine); etc. Specific examples of the polyamines (B2) having three or more amino groups include diethylene triamine, triethylene tetramine. Specific examples of the amino alcohols (B3) include ethanol amine and hydroxyethyl aniline. Specific examples of the amino mercaptan (B4) include aminoethyl mercaptan and aminopropyl mercaptan. Specific examples of the amino acids (B5) include amino propionic acid and amino caproic acid. Specific examples of the blocked amines (B6) include ketimine compounds which are prepared by reacting one of the amines B1–B5 mentioned above with a ketone such as acetone, methyl ethyl ketone and methyl isobutyl ketone; oxazoline compounds, etc. Among these compounds, diamines (B1) and mixtures in which a diamine (B1) is mixed with a small amount of a polyamine (B2) are preferred.

The mixing ratio (i.e., a ratio [NCO]/[NHx]) of the content of the prepolymer (A) having an isocyanate group to the amine (B) ranges from 1/2 to 2/1, preferably from 1.5/1 to 1/1.5, and more preferably from 1.2/1 to 1/1.2. When the mixing ratio is too low or too high, the molecular weight of the resultant urea-modified polyester decreases, resulting in deterioration of the hot offset resistance of the resultant toner.

The modified polyesters may include a urethane linkage as well as a urea linkage. The molar ratio (urea/urethane) of the urea linkage to the urethane linkage may vary from 100/0 to 10/90, preferably from 80/20 to 20/80, and more preferably from 60/40 to 30/70. When the content of the urea linkage is too low, the hot offset resistance of the resultant toner deteriorates.

Modified polyesters (i) for use in the present invention are prepared by one-shot methods and prepolymer methods. The weight average molecular weight of the modified polyesters (i) is not less than 10,000, preferably from 20,000 to 10,000,000, and more preferably from 30,000 to 1,000,000. The number average molecular weight of the urea-modified polyester is not particularly limited (i.e., the weight average molecular weight should be primarily controlled so as to be in the range mentioned above) when the unmodified polyester resin mentioned above is used in combination. However, when the modified polyester is used alone, the number average molecular weight thereof is from 2,000 to 15,000, preferably from 2,000 to 10,000 and more preferably from 2,000 to 8,000. When the number average molecular weight is too large, the low temperature fixability of the resultant toner deteriorates, and in addition the gloss of full color images decreases when the toner is used in a full color image forming apparatus.

In the crosslinking reaction and/or elongation reaction of a polyester prepolymer (A) with an amine (B) to obtain a modified polyester (i), a reaction inhibitor can be used if desired to control the molecular weight of the resultant urea-modified polyester. Specific examples of such a reaction inhibitor include monoamines (e.g., diethyl amine, dibutyl amine, butyl amine and lauryl amine), and blocked amines (i.e., ketimine compounds) prepared by blocking the monoamines mentioned above.

(Unmodified Polyester)

It is possible to use not only a modified polyester (i) alone but also a combination of a modified polyester (i) and an unmodified polyester (ii) as a binder constitutional component. By using the combination, the low temperature fixability of the toner improves and in addition color images having high gloss can be obtained when the toner is used in the full-color image forming apparatus 100. Therefore, the combinational use of an unmodified polyester and a modified polyester is preferred to a single use of the modified polyester. Specific examples of such unmodified polyesters (ii) include the same polycondensation compounds of polyols (PO) and polycarboxylic acids (PC) of the polyester components as mentioned for the modified polyester (i). Their suitably preferred compounds are the same as those for the modified polyester (i). The unmodified polyesters (ii) include not only non-modified polyesters but also modified polyesters modified by a chemical linkage such as a urethane linkage other than a urea linkage. When a mixture of a modified polyester (i) with a urea-unmodified polyester (ii) is used, it is preferred that the modified polyester (i) at least partially mix with the unmodified polyester (ii) in terms of the low temperature fixability and hot offset resistance of the resultant toner. Namely, it is preferred that the unmodified polyester (i) has a structure similar to that of the urea-modified polyester (ii). The mixing weight ratio of the modified polyester (i) to the unmodified polyester (ii) varies from 5/95 to 80/20, preferably from 5/95 to 30/70, more preferably from 5/95 to 25/75, and even more preferably from 7/93 to 20/80. When the mixture amount of the modified polyester (i) is too small, the hot offset resistance of the resultant toner deteriorates and, in addition, it is difficult to impart a good combination of high temperature preservability and low temperature fixability to the resultant toner.

The unmodified polyester resin (ii) preferably has a hydroxyl value at least 5, more preferably from 10 to 120, and even more preferably from 20 to 80. When the unmodified polyester resin has a hydroxyl value less than 5, it is difficult to impart a good combination of high temperature preservability and low temperature fixability to the resultant toner. The unmodified polyester resin (ii) preferably has an acid value of from 1 to 5 and more preferably from 2 to 4. Further, the acid value of a toner affects chargeability and volume resistance. Thus, when a wax has a high acid value, it is preferred to use a binder resin having a low acid value to have a suitable acid value for the toner as a whole.

The binder resin has a glass transition temperature (Tg) of from 35 to 70° C., and preferably from 55 to 65° C. When the glass transition temperature is too low, the high temperature preservability of the toner deteriorates. In contrast, when the glass transition temperature is too high, the low temperature fixability of the toner deteriorates. Since a urea-modified polyester resin tends to exist on the surface of the mother toner particle obtained, the resultant toner tends to show good high temperature preservability in comparison with conventional toners containing a polyester resin as a binder resin even if the binder resin has a relatively low glass transition temperature.

Colorants, charge controlling agents, and release agents for use in the present invention can be suitably selected from known materials.

(Colorant)

Suitable colorants for use in the toner of the present invention include known dyes and pigments.

Specific examples of the colorants include carbon black, Nigrosine dyes, black iron oxide, Naphthol Yellow S, Hansa Yellow (10G, 5G and G), Cadmium Yellow, yellow iron oxide, loess, chrome yellow, Titan Yellow, polyazo yellow, Oil Yellow, Hansa Yellow (GR, A, RN and R), Pigment Yellow L, Benzidine Yellow (G and GR), Permanent Yellow (NCG), Vulcan Fast Yellow (5G and R), Tartrazine Lake, Quinoline Yellow Lake, Anthrazane Yellow BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, Permanent Red (F2R, F4R, FRL, FRLL and F4RH), Fast Scarlet VD, Vulcan Fast Rubine B, Brilliant Scarlet G, Lithol Rubine GX, Permanent Red F5R, Brilliant Carmine 6B, Pigment Scarlet 3B, Bordeaux 5B, Toluidine Maroon, Permanent Bordeaux F2K, Helio Bordeaux BL, Bordeaux 10B, BON Maroon Light, BON Maroon Medium, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, Indanthrene Blue (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone and the like. These materials can be used alone or in combination.

The content of the colorant in the toner is preferably from 1 to 15% by weight, and more preferably from 3 to 10% by weight, based on the total weight of the toner.

(Charge Controlling Agent)

The toner of the present invention optionally includes a charge controlling agent. Known charge controlling agents can be used for the toner of the present invention either singly or as a combination of 2 or more. Specific preferred examples of the charge controlling agents include nigrosine dyes, triphenyl methane dyes, metal compounds dyes including chrome, chelate compounds of molybdic acid, Rhodamine dyes, alkoxyamines, quaternary ammonium salts (including fluorine-modified quaternary ammonium salts), alkylamides, phosphor and compounds including phosphor, tungsten and compounds including tungsten, fluorine-containing activators, metal salts of salicylic acid, metal salts of salicylic acid derivatives, etc.

Specific more preferred examples of the charge controlling agents include BONTRON 03 (nigrosine dyes), BONTRON P-51 (quaternary ammonium salt), BONTRON E-82 (metal complex of oxynaphthoic acid), BONTRON S-34 (azo dyes containing a metal), BONTRON E-84 (metal complex of salicylic acid), and BONTRON E-89 (phenolic condensation product), which are manufactured by Orient Chemical Industries Co., Ltd.; TP-302 and TP-415 (molybdenum complex of quaternary ammonium salt), which are manufactured by Hodogaya Chemical Co., Ltd.; COPY CHARGE PSY VP2038 (quaternary ammonium salt), COPY BLUE PR (triphenyl methane derivative), COPY CHARGE NEG VP2036 and COPY CHARGE NX VP434 (quaternary ammonium salt), which are manufactured by Hoechst AG; LRA-901, and LR-147 (boron complex), which are manufactured by Japan Carlit Co., Ltd.; copper phthalocyanine, perylene, quinacridone, azo pigments, and polymers having a functional group such as a sulfonate group, a carboxyl group, a quaternary ammonium group, etc. Among these, it is particularly preferred to use a material that can control the polarity of the toner to be negative.

The content of charge controlling agents in the toner of the present invention depends on the kind of the toner binder resin used, whether other additives are used, and the toner manufacturing method used (including the dispersing method) and therefore there is no specific limitation thereto. However, it is preferable that the charge controlling agent be used in an amount of from 0.1 to 10 parts by weight per 100 parts by weight of the binder resin and more preferably of from 0.2 to 5 parts by weight. When the amount is greater than 10 parts by weight, the toner is so excessively charged that electrostatic attraction force between the toner and a developing roller increases, resulting in deterioration of fluidity of the developer and deterioration of image density.

(Release Agent)

With regard to release agents contained in the toner, since waxes having a low melting point of from 50 to 120° C. can effectively function between a fixing roller and the surface of the toner as a release agent in dispersion with a binder resin, such waxes can have a good effect on hot temperature offset without applying a release agent such as an oil to the fixing roller. Specific examples of such wax compositions include vegetative waxes such as carnauba wax, cotton wax, wood wax and rice wax, animal waxes such as bees wax and lanoline, mineral waxes such as ozokerite and ceresin, oil waxes such as paraffin, microcrystalline and petrolatum. Other than these natural waxes, also the following synthetic waxes can be used: synthetic hydro carbon waxes such as Fischer-Tropsch (synthesis) waxes and polyethylene waxes and synthetic waxes such as esters, ketones and ethers. In addition, it is possible to use fatty acid amides such as 12-hydroxystearic acid amides, stearic acid amides, anhydrate phthalic acid imides and chlorinated hydrocarbons, and crystalline polymers having a long alkyl group in its branched chain such as homopolymers or copolymers of polyacrylates such as poly-n-steacrylic methacrylate, poly-n-lauryl methacrylate and n-stearyl acrylate-ethyl methacrylate.

The method of manufacturing the toner for use in the present invention is now described. However, the manufacturing method is not limited to the examples presented herein below.

(Method of Manufacturing a Toner)

(1) First, toner constituents including a colorant, an unmodified polyester resin, a polyester prepolymer having an isocyanate group, and a release agent are dissolved or dispersed in an organic solvent to prepare a toner constituent liquid.

Suitable preferred organic solvents include volatile organic solvents having a boiling point lower than 100° C. since such solvent can be easily removed from the resultant toner particle dispersion.

Specific examples of the organic solvents include toluene, xylene, benzene, carbon tetrachloride, methylene chloride, 1,2-dichloroethane, 1,1,2-trichloroethane, chloroform, monochlorobenzene, dichloroethylidene, methyl acetate, ethyl acetate, methyl ethyl ketone, methyl isobutyl ketone, etc. These can be used alone or in combination. In particular, aromatic solvents such as toluene and xylene, and halogenated hydrocarbons such as 1,2-dichloroethane, chloroform and carbon tetrachloride are preferably used.

The addition quantity of the organic solvent is from 0 to 300 parts by weight, preferably from 0 to 100 parts by weight and more preferably from 25 to 70 parts by weight, per 100 parts by weight of the polyester prepolymer used.

(2) Next, the toner constituent liquid is emulsified in an aqueous medium in the presence of a surface active agent and a particulate resin.

Suitable aqueous media include water, and mixtures of water with alcohols (such as methanol, isopropanol and ethylene glycol), dimethylformamide, tetrahydrofuran, cellosolves (such as methyl cellosolve) and lower ketones (such as acetone and methyl ethyl ketone).

The mixing ratio (A/T) of the aqueous medium (A) to the toner constituent liquid (T) is from 50/100 to 2000/100 by weight, and preferably from 100/100 to 1000/100 by weight. When the content of the aqueous medium is too low, the toner constituent liquid is not well dispersed, and thereby toner particles having a desired particle diameter are not produced. In contrast, when the content of the aqueous medium is too high, the manufacturing cost of the toner increases.

When the toner constituent liquid is dispersed in an aqueous medium, a dispersant such as surface active agents and particulate resins can be preferably used to prepare a stable dispersion.

Specific examples of the surface active agents include anionic surface active agents such as alkylbenzene sulfonic acid salts, α-olefin sulfonic acid salts, and phosphoric acid salts; cationic surface active agents such as amine salts (e.g., alkyl amine salts, aminoalcohol fatty acid derivatives, polyamine fatty acid derivatives and imidazoline), and quaternary ammonium salts (e.g., alkyltrimethyl ammonium salts, dialkyldimethyl ammonium salts, alkyldimethyl benzyl ammonium salts, pyridinium salts, alkyl isoquinolinium salts and benzethonium chloride); nonionic surface active agents such as fatty acid amide derivatives, polyhydric alcohol derivatives; and ampholytic surface active agents such as alanine, dodecyldi(aminoethyl)glycin, di(octylaminoethyle)glycin, and N-alkyl-N,N-dimethylammonium betaine.

By using a surfactant having a fluoroalkyl group, a good dispersion can be prepared even when an extremely small amount of the surfactant is used. Specific examples of the anionic surfactants having a fluoroalkyl group include fluoroalkyl carboxylic acids having from 2 to 10 carbon atoms and their metal salts, disodium perfluoro octanesulfonylglutamate, sodium 3-{omega-fluoroalkyl(C6–C11)oxy}-1-alkyl(C3–C4) sulfonate, sodium 3-{omega-fluoroalkanoyl (C6–C8)-N-ethylamino}-1-propanesulfonate, fluoroalkyl (C11–C20) carboxylic acids and their metal salts, perfluoroalkylcarboxylic acids and their metal salts, perfluoroalkyl(C4–C12)sulfonate and their metal salts, perfluorooctanesulfonic acid diethanol amides, N-propyl-N-(2-hydroxyethyl)perfluorooctanesulfone amide, perfluoroalkyl (C6–C10)sulfoneamidepropyltrimethylammonium salts, salts of perfluoroalkyl(C6–C10)-N-ethylsulfonyl glycin, monoperfluoroalkyl(C6–C16)ethylphosphates, etc.

Specific examples of the marketed products of such surfactants having a fluoroalkyl group include SURFLON® S-111, S-112 and S-113, which are manufactured by Asahi Glass Co., Ltd.; FRORARD® FC-93, FC-95, FC-98 and FC-129, which are manufactured by Sumitomo 3M Ltd.; UNIDYNE® DS-101 and DS-102, which are manufactured by Daikin Industries, Ltd.; MEGAFACE® F-110, F-120, F-113, F-191, F-812 and F-833 which are manufactured by Dainippon Ink and Chemicals, Inc.; ECTOP® EF-102, 103, 104, 105, 112, 123A, 306A, 501, 201 and 204, which are manufactured by Tohchem Products Co., Ltd.; FUTARGENT® F-100 and F150 manufactured by Neos; etc.

Specific examples of the cationic surfactants having a fluoroalkyl group include primary, secondary and tertiary aliphatic amino acids, aliphatic quaternary ammonium salts (such as perfluoroalkyl(C6–C10)sulfoneamidepropyltrimethyl ammonium salts), benzalkonium salts, benzetonium chloride, pyridinium salts, imidazolinium salts, etc., all of which have a fluoroalkyl group Specific examples of commercially available products of these elements include SURFLON® S-121 (from Asahi Glass Co., Ltd.); FRORARD® FC-135 (from Sumitomo 3M Ltd.); UNIDYNE® DS-202 (from Daikin Industries, Ltd.); MEGAFACE® F-150 and F-824 (from Dainippon Ink and Chemicals, Inc.); ECTOP® EF-132 (from Tohchem Products Co., Ltd.); FUTARGENT® F-300 (from Neos); etc.

Any particulate resins, for example, particulate thermal plastic resins and thermal curing resins, can be used as long as the resin can form an aqueous dispersion. Specific examples of such particulate resins include vinyl containing resins, polyurethane resins, epoxy resins, polyester resins, polyamide resins, polyimide resins, silica containing resins, phenol resins, melamine resins, urea resins, aniline reins, ionomer resins and polycarbonate resins. These resins mentioned above can be used alone or in combination thereof. Among them, vinyl containing resins, polyurethane resins, epoxy resins and polyester resins and their combinational use are preferred since aqueous dispersions of a particulate resin having a sphere form can be easily formed. Specific examples of vinyl containing resins include polymers which are singly polymerized or copolymerized from vinyl containing monomers such as resins of styrene-(meth)acrylic ester copolymers, styrene-butadiene copolymers, (meth) acrylic acid-acrylic ester copolymers, styrene-acrylonitrile copolymers, styrene-maleic anhydride copolymers, styrene-(meth)acrylic acid copolymers. The average particle diameter of the particulate resins is from 5 to 200 nm and preferably from 20 to 300 nm.

In addition, an inorganic dispersant can be added to the aqueous medium. Specific examples of the inorganic dispersants include tricalcium phosphate, calcium carbonate, titanium oxide, colloidal silica, hydroxyapatite, etc.

Further, it is possible to stably disperse toner constituents in an aqueous medium using a polymeric protection colloid in combination with the inorganic dispersants and/or particulate polymers mentioned above.

Specific examples of such protection colloids include polymers and copolymers prepared using monomers such as acids (e.g., acrylic acid, methacrylic acid, α-cyanoacrylic acid, α-cyanomethacrylic acid, itaconic acid, crotonic acid, fumaric acid, maleic acid and maleic anhydride), acrylic monomers having a hydroxyl group (e.g., β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethyleneglycolmonoacrylic acid esters, diethyleneglycolmonomethacrylic acid esters, glycerinmonoacrylic acid esters, N-methylolacrylamide and N-methylolmethacrylamide), vinyl alcohol and its ethers (e.g., vinyl methyl ether, vinyl ethyl ether and vinyl propyl ether), esters of vinyl alcohol with a compound having a carboxyl group (i.e., vinyl acetate, vinyl propionate and vinyl butyrate); acrylic amides (e.g, acrylamide, methacrylamide and diacetoneacrylamide) and their methylol compounds, acid chlorides (e.g., acrylic acid chloride and methacrylic acid chloride), and monomers having a nitrogen atom or an alicyclic ring having a nitrogen atom (e.g., vinyl pyridine, vinyl pyrrolidone, vinyl imidazole and ethylene imine).

In addition, polymers such as polyoxyethylene compounds (e.g., polyoxyethylene, polyoxypropylene, polyoxyethylenealkyl amines, polyoxypropylenealkyl amines, polyoxyethylenealkyl amides, polyoxypropylenealkyl amides, polyoxyethylene nonylphenyl ethers, polyoxyethylene laurylphenyl ethers, polyoxyethylene stearylphenyl esters, and polyoxyethylene nonylphenyl esters), and cellulose compounds such as methyl cellulose, hydroxyethyl cellulose and hydroxypropyl cellulose, can also be used as the polymeric protective colloid.

The dispersion method is not particularly limited, and low speed shearing methods, high speed shearing methods, friction methods, high pressure jet methods, ultrasonic methods, etc. can be used. Among these methods, high speed shearing methods are preferable because particles having a particle diameter of from 2 μm to 20 μm can be easily prepared. At this point, the particle diameter (2 to 20 μm) means a particle diameter of particles including a liquid.

When a high speed shearing type dispersion machine is used, the rotation speed is not particularly limited, but the rotation speed is typically from 1,000 to 30,000 rpm, and preferably from 5,000 to 20,000 rpm. The dispersion time is not also particularly limited, but is typically from 0.1 to 5 minutes. The temperature in the dispersion process is typically from 0 to 150° C. (under pressure), and preferably from 40 to 98° C.

(3) At the same time when a toner constituent is dispersed in an aqueous medium, an amine (B) is added to the aqueous medium to be reacted with the polyester prepolymer (A) having an isocyanate group.

This reaction accompanies crosslinking and/or elongation of the molecular chains of the polyester prepolymer (A). The reaction time is determined depending on the reactivity of the amine (B) with the polyester prepolymer used, but is typically from 10 minutes to 40 hours, and preferably from 2 to 24 hours. The reaction temperature is from 0 to 150° C., and preferably from 40 to 98° C. In addition, known catalysts such as dibutyltin laurate and dioctyltin laurate can be used for the reaction, if desired.

(4) After the reaction, the organic solvent is removed from the resultant dispersion (emulsion, or reaction product), and then the solid components are washed and then dried. Thus, a mother toner is prepared.

To remove the organic solvent, the whole system is gradually heated while agitated under laminar flow conditions. Then the system is strongly agitated in a certain temperature range, followed by solvent removal, to prepare a mother toner having a spindle form.

In this case, when a compound such as calcium phosphate, which is soluble in an acid or alkali, is used as a dispersion stabilizer, the compound is dissolved by an acid such as hydrochloric acid, followed by washing of the resultant particles with water to remove the salt of calcium phosphate therefrom. In addition, calcium phosphate can be removed using a zymolytic method.

(5) Subsequently, a charge controlling agent is fixedly adhered to the mother toner particles obtained as mentioned above. In addition, an external inorganic additive, such as combinations of a particulate silica and a particulate titanium oxide, is adhered to the mother toner particles to prepare the toner of the present invention.

Known methods can be used for the fixed adhesion of a charge controlling agent and the external addition of inorganic particulates. By using this manufacturing method, the resultant toner can have a relatively small particle diameter and a narrow particle diameter distribution. By providing vigorous agitation during the solvent removing process, the shape of the toner can be controlled so as to be of a desired form, i.e., a form between a rugby ball and a true sphere form. In addition, the surface characteristics of the toner can also be controlled to produce a surface having a desired roughness, i.e., a surface that is not too smooth or too rough.

The toner of the present invention preferably has a substantially sphere form, which can be determined by the following form description.

Figure 6A:
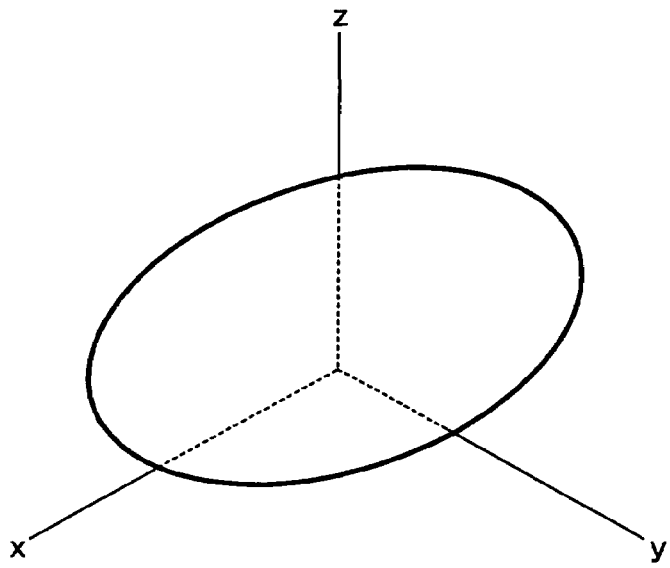
FIGS. 6A to 6C are schematic diagrams explaining a toner for use in the image forming apparatus of FIG. 1.
Figure 6B:
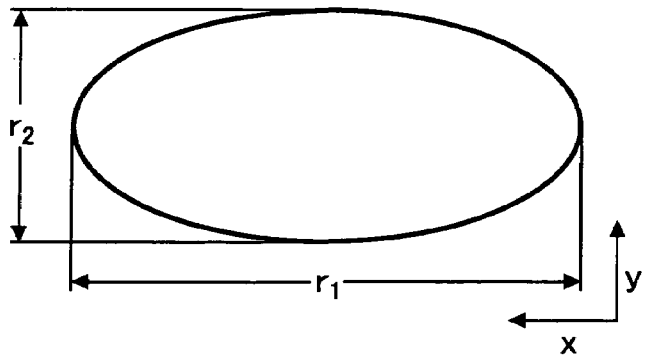
Figure 6C:
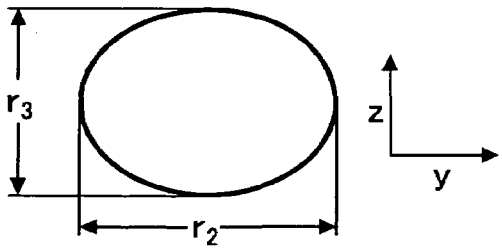

FIG. 6 is a schematic diagram illustrating the form of the toner particle of the present invention. When the form of the toner of the present invention is determined by its major axis (r1), its minor axis (r2), and its thickness (r3) while these three factors satisfy the following relationship: r1> or =r2> or =r3, the ratio of r2 to r1 (refer to FIG. 6B) is preferably from 0.5 to 1.0 and the ratio of r3 to r2 (refer to FIG. 6C) is preferably from 0.7 to 1.0. When the ratio of r2/r1 is too small, the form of the toner particles is away from a sphere form so that the toner tends to be insufficient in dot representation and transfer efficiency, resulting in formation of low quality images.

When the ratio of r3/r2 is too small, the toner form is closer to a flat form so that, unlike the case of a toner having a sphere form, a high transfer rate is not obtained. When the ratio of r3/r2 is 1.0, the toner particle revolves around the major axis thereof and the fluidity thereof can be improved.

The particle dimensions r1, r2 and r3 of the toner can be determined by taking photos of the toner particles using a scanning electron microscope (SEM) while observing the particles from different angles.

The toner manufactured as mentioned above can be used as a single component magnetic or nonmagnetic toner without using a magnetic carrier. When the toner is used in a two component developer, the toner can be mixed with a magnetic carrier. Specific examples of such magnetic carriers include ferrites including divalent metal such as iron, magnetite, manganese, zinc and copper and its weight average particle diameter D is preferably from 20 to 100 μm. When the weight average particle diameter D is too small, the carrier tends to attach to the image bearing member 1 at the time of developing. When the weight average particle diameter D is too large, the carrier does not mix with the toner properly so that the toner is not sufficiently charged and poor charging tends to occur when the toner is continuously used. Copper ferrite including zinc is preferred because its saturation magnetization is high. However, a magnetic carrier can be selected among the carrier mentioned above according to the process of the image forming apparatus 100. Resins to cover the magnetic carrier are not limited. Specific examples of such resins include silicone resins, styrene-acryl resins, fluorine containing resins, and olefin resins. These resins can be manufactured as follows: dissolve a particulate resin in a solvent; and spray the obtained liquid in a flow to coat it on core materials, or electrostatically attach a particulate resin to core particles; and fuse the obtained particles upon application of heat. The thickness of a resin for covering is from 0.05 to 10 μm and preferably from 0.3 to 4 μm.

The image forming apparatus can contain a removable process cartridge 2 that contains the image bearing member 1 and a device or devices selected from the group consisting of the charging device 3, the developing device, 5 and the cleaning device 7. Thereby a developer and the developing device 5 can be easily replaced so that the image forming apparatus 100 can be used for a long period of time.

Having generally described preferred embodiments of this invention, further understanding can be obtained by reference to certain specific examples provided herein for the purpose of illustration only and that are not intended to be limiting. In the descriptions in the following examples, the numbers represent weight ratios in parts, unless otherwise specified.

EXAMPLES

The present invention is now described in detail.

Example 1

<Manufacturing an Image Bearing Member>

The image forming apparatus for use in the present invention was manufactured as follows;

(1) The electroconductive substrate was manufactured from aluminum alloyed metal by a DC casting method to obtain an aluminum alloyed metal billet. The cross section of the obtained billet was processed by hot extrusion to obtain a tube having a cylinder form. Thereafter, the manufactured cylindrical tube was cut to have a length of 340 mm to obtain a rough tube reserved for cutting work. The obtained rough tube was fitted on a lathe turning machine.

The surface of the rough tube was subject to cutting work and an electroconductive substrate for an electrophotographic image bearing member having an outer diameter of 30 mm and a surface roughness Rz of 1.2 μm was manufactured;

(2) Next, the surface of the electroconductive substrate was rinsed with a revolving brush while pouring water containing a surface active agent to the surface thereof. Further, the surface of the electroconductive substrate was rinsed with purified water. A resin coating material containing 90 parts of titan oxide, 15 parts of an alkyd resin, 10 parts of a melamine resin and 150 parts of methyl ethyl ketone was coated on the surface of the electroconductive substrate by a dip coating. Thereafter the electroconductive substrate was heated for 20 minutes at 130° C. to form an undercoat layer having a thickness of 3.5 μm on the electroconductive substrate;

(3) Four parts of polyvinyl butyral resin (XYHL manufactured by UCC CO., LTD.) was dissolved in 150 parts of cyclohexanone and 10 parts of a bisazo dye was added thereto. Subsequent to 48 hour dispersion in a ball mill, 210 parts of cyclohexanone was added thereto and 3 hour dispersion was performed. The obtained dispersion liquid was removed to a container and diluted with cyclohexanone such that a solid portion thereof was 1.5 weight %. The thus obtained coating liquid for a charge generation layer was applied to the undercoat layer mentioned above and dried at 130° C. for 20 minutes to form a charge generation layer having a thickness of 0.2 μm;

(4) Ten parts of a bisphenol Z type polycarbonate resin and 0.002 parts of silicone oil (KF-50 manufactured by Shin-Etsu Chemical Co., Ltd.) were dissolved in 100 parts of tetrahydrofuran. Thereafter 10 parts of a charge transport material were added thereto to obtain a coating liquid for a charge transport layer. The thus obtained coating liquid was applied to the charge generation layer by a dip coating method and dried at 110° C. for 20 minutes to form a charge transport layer having a thickness of 20 μm;

(5) Further, a protective layer was formed on the charge transport layer. Eighteen parts of particulate perfluoroalkoxy resin (PFA: Product name MPE-056, manufactured by Du Pont-Mitsui Fluorochemical Company, Ltd.) and a dispersion helper agent (product name: MODIPER® F210 manufactured by NOF Corporation) were admixed in a mixture solvent containing 60 parts of tetrahydrofuran and 20 parts of cyclohexanone. The mixture was cycled for an hour under a pressure of 100 MPa using a high pressure water disperser (Product name: ULTIMIZER® HJP-25005 manufactured by Sugino Machine Limited) to obtain PFA dispersion liquid. In addition, a resin liquid was prepared by dissolving 16 parts of bisphenol Z type polycarbonate resin in a mixture solvent containing 420 parts of tetrahydrofuran and 120 parts of cyclohexane and mixed with 55 parts of the PFA dispersion liquid mentioned above to obtain a coating liquid. The coating liquid was irradiated with supersonic wave for 10 minutes to obtain a coating liquid for forming a protective layer. The thus obtained coating liquid for forming a protective layer was applied to the charge transport layer with a spray gun (PIECECOM PC308 manufactured by Olympos Co. Ltd.) under an air pressure of 2 kgf/cm. After coating three times, the coating liquid was dried at 130° C. for 20 minutes to form a protective layer having a thickness of 5 μm;

(6) A flange made of a polycarbonate resin was press-fitted into the thus prepared electrophotographic image bearing member. The fitting portion of the flange was fitted with several droplets of an adhesive agent (bond ARON ALPHA® manufactured by Toagosei Chemical Industry Co., Ltd.). The image bearing member A was thus manufactured.

Figure 7:
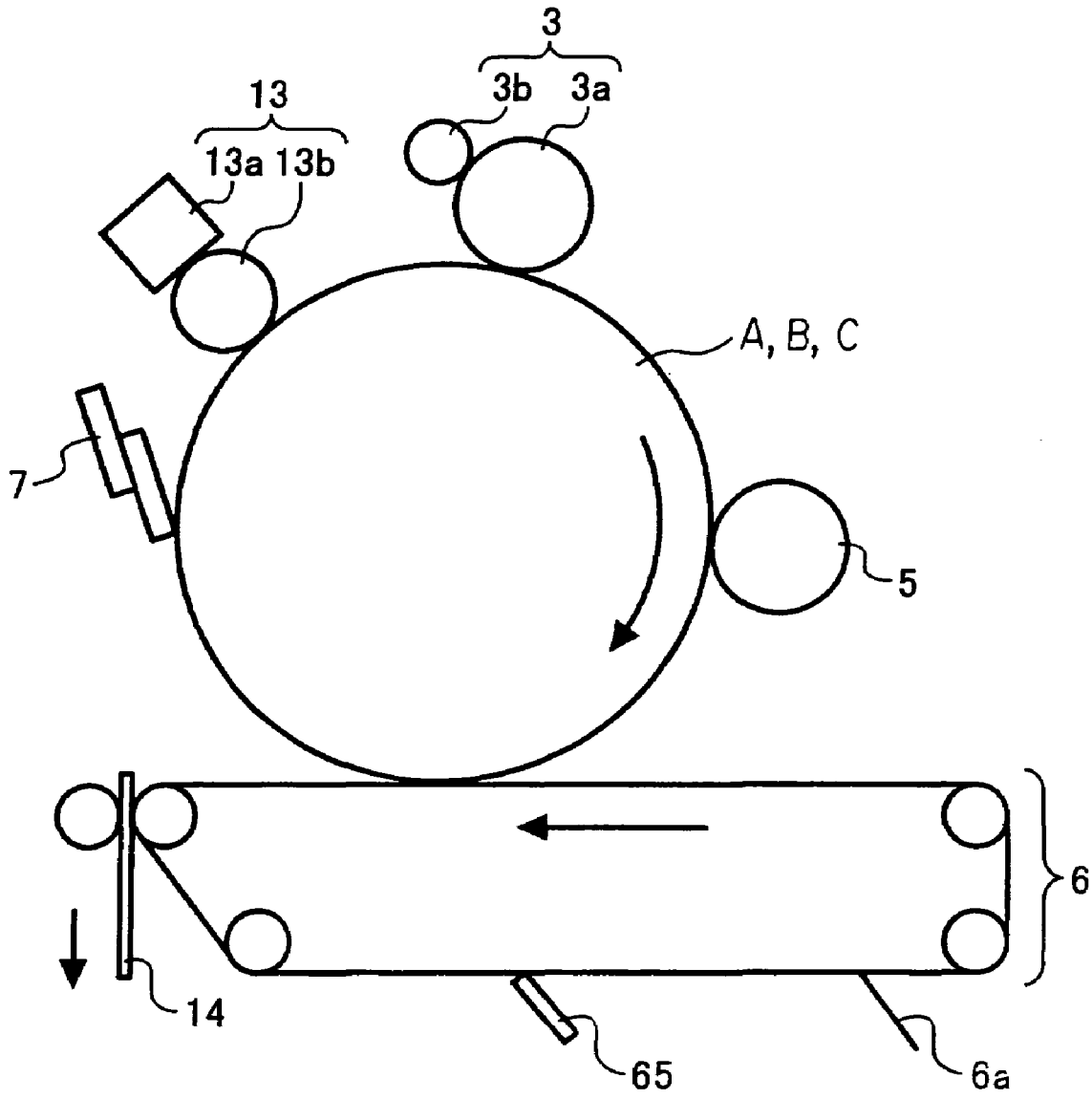
FIG. 7 is a schematic diagram illustrating a device used for measuring the dynamic torque and cleaning property of an image bearing member.

The thus obtained image bearing member A was set on a device having the structure illustrated in FIG. 7. In FIG. 7, a solid lubricant applying device 13 was provided to supply a solid lubricant 13*a* to the image bearing member A. A rotation brush 13*b* included in the solid lubricant applying device 3 shaved off lubricant from the solid lubricant 13*a* while abrasively and rotationally contacting with the solid lubricant 13*a*. The shaved lubricant was applied to the image bearing member A while the rotation brush 13*b* rubbed the lubricant thereon against the image bearing member A. After running 1,000 sheets, torque was measured by a torque measuring device and cleaning performance of the image forming apparatus was evaluated.

<Torque Measurement by Torque Measuring Device>

The torque measuring device 200 measured a torque of an inorganic image bearing member A having an outer diameter of 30 mm and a length of 340 mm. The contact conditions of the cleaning blade 7*a* made of urethane rubber was a contact angle of 75° and a contact pressure of 0.26 N/cm.

(Measuring Method)

The torque measuring device 200 recorded the variance of the torque when the cleaning blade was brought into contact with the image bearing member A as manufactured above under the conditions mentioned above while driving the image bearing member A at 79.5 rpm for 15 seconds and driving the developing device. The average values for 15 seconds are shown in Table 1.

<Evaluation of Cleaning Performance of the Image Forming Apparatus>

The following two-component developer containing a carrier and a toner was used. The carrier was ferrite carrier having an average particle diameter on which a silicone resin was coated with the average thickness of 5 μm. The toner was prepared as follows. A styrene acrylic resin, carbon black and carnauba wax were fused and mixed and the mixture was pulverized and classified to obtain a toner having a weight average particle diameter of 6.8 μm. The toner was uniformly mixed with the carrier by a turbla mixer in which the vessel was tumbled for stirring to charge the toner. The ratio of the carrier to the toner was 100/8. The developer was thus prepared.

The image bearing member A as manufactured above was set on an evaluation image forming apparatus and cleaning performance was evaluated. The evaluation was performed for two image forming apparatuses, which were a color printer ($Dm^3/V=1.23$) having the image bearing member A having a circumference velocity of 245 mm/sec. and a monochrome printer ($Dm^3/V=0.63$) having the image bearing member A having a circumference velocity of 500 mm/sec, using only a black toner. The cleanability was determined whether or not background development was prevented by cleaning after a running of 50,000 sheets under the condition of room temperature and normal humidity.

Example 2

Another image bearing member B was manufactured in the same manner as described in Example 1 except for the process (5). In the process (5) of Example 2, 4 parts of bisphenol z type polycarbonate resin was dissolved in a mixture solvent containing 280 parts of tetrahydrofuran and 80 parts of cyclohexanone. Thereafter 0.7 parts of particulate aluminum having a specific resistance of $2.5\times10^{12}$ Ωcm was added thereto. The obtained mixture was dispersed with a ball mill for two hours to obtain a coating liquid for a protective layer. The thus obtained coating liquid for forming a protective layer was applied to the charge transport layer by a spray gun (PIECECOM PC308 manufactured by Olympos CO. Ltd.) with an air pressure of 2 kgf/cm. After applying the coating liquid three times, the coating liquid was dried at 130° C. for 20 minutes to form a protective layer having a thickness of 5 μm.

The thus obtained image bearing member B was set on a device having the structure illustrated in FIG. 7. After running 1,000 sheets, torque was measured by the torque measuring device and cleaning performance of the image forming apparatus was evaluated in the same manner as described in Example 1.

Comparative Example 1

<Manufacturing Image Bearing Member C>

An image bearing member C, which did not contain a lubricant, was manufactured for Comparative Example 1. The image bearing member C was manufactured in the same manner as described in Example 1 except for the process (5). In the process (5) in Comparative Example 1, 4 parts of bisphenol z type polycarbonate resin were dissolved in a mixture solvent containing 280 parts of tetrahydrofuran and 80 parts of cyclohexanone. Thereafter 0.7 parts of particulate aluminum having a specific resistance of $2.5\times10^{12}$ Ωcm were added thereto. The obtained mixture was dispersed with a ball mill for two hours to obtain a coating liquid for a protective layer. The thus obtained coating liquid for forming a protective layer was applied to the charge transport layer by a spray gun (PIECECOM PC308 manufactured by Olympos Co. Ltd.) with an air pressure of 2 kgf/cm. After applying the coating liquid three times, the coating liquid was dried at 130° C. for 20 minutes to form a protective layer having a thickness of 5 μm.

Torque was measured for the image bearing member C by the torque measuring device and cleaning performance therefor was evaluated in the same manner as described in Example 1.

Figure 8A:
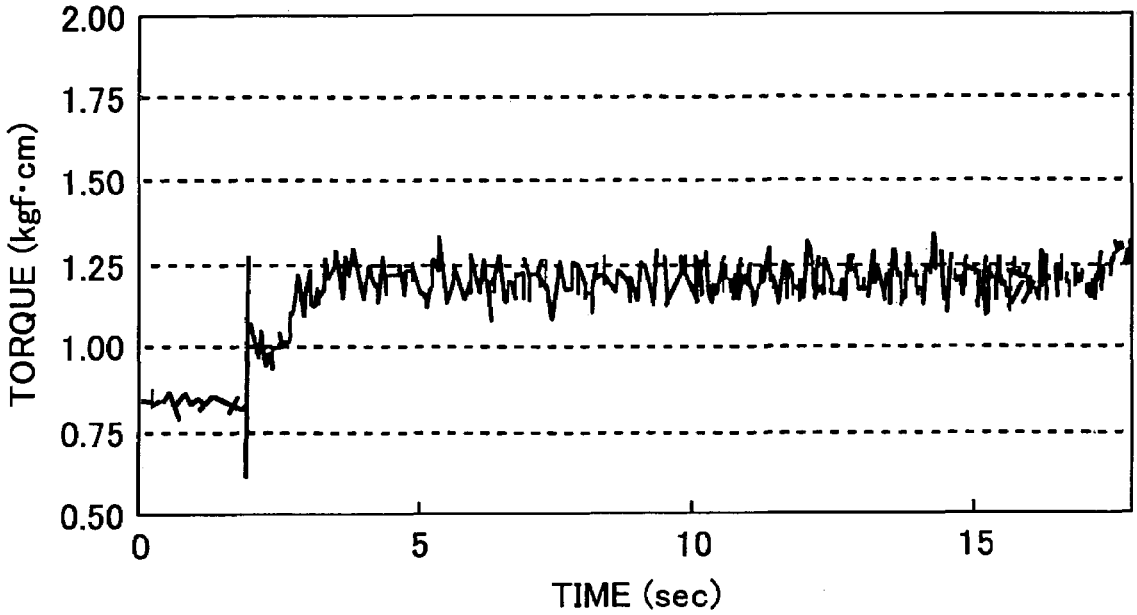
FIGS. 8A and 8B are graphs illustrating measuring results for good cleaning performance and poor cleaning performance, respectively.
Figure 8B:
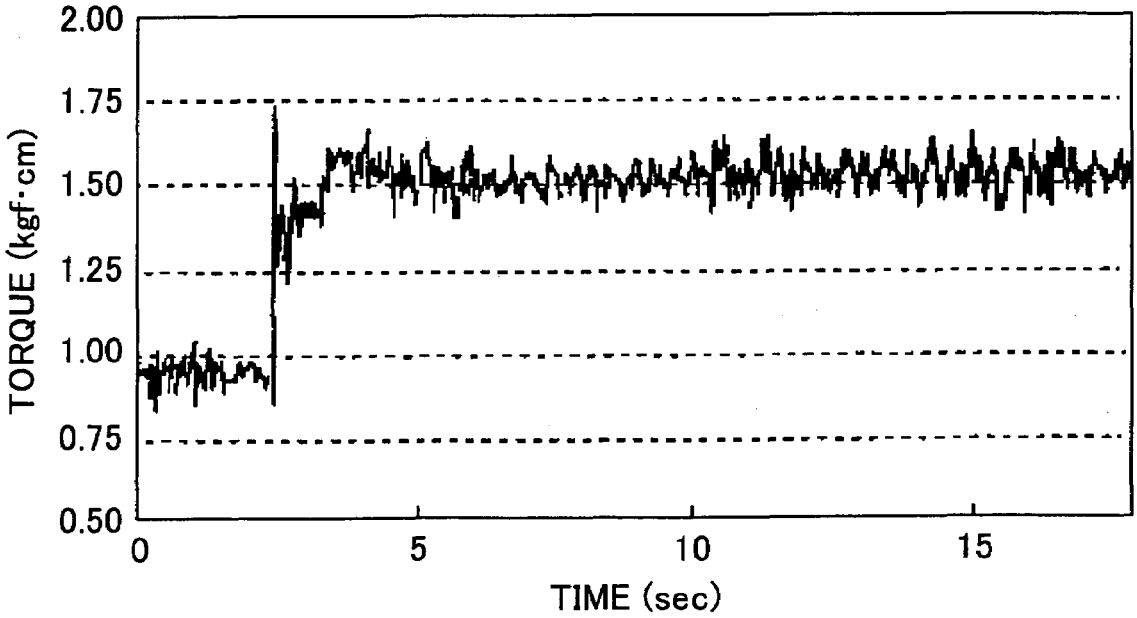

FIGS. 8A and 8B show the results of the measurements by the torque measuring device. FIG. 8A shows an example of good cleaning performance and FIG. 8B shows an example of poor cleaning performance.

The results of Examples 1 and 2 and Comparative Example 1 are shown in Table 1.

TABLE 1

| | | Evaluation of cleaning performance | |
|---|---|---|---|
| | $T_{ave.}$ | Color printer | Monochrome printer |
| Example 1 | 1.192 | No background development | No background development |
| Example 2 | 1.051 | No background development | No background development |
| Comparative Example 1 | 1.519 | Background development | Background development |

As seen in Table 1, in Examples 1 and 2, their torque averages $T_{ave.}$ were not greater than 1.40 kgf·cm and no background development was observed for the actual machine tests. In contrast, in Comparative Example 1, its torque average $T_{ave.}$ was more than 1.40 kgf·cm and background development was observed for the actual machine tests.

This document claims priority and contains subject matter related to Japanese Patent Applications Nos. 2004-048939 and 2005-46708, filed on Feb. 25, 2004, and Feb. 23, 2005, respectively, the entire contents of each of which are hereby incorporated herein by reference.

Having now fully described embodiments of the present invention, it will be apparent to one of ordinary skill in the art that many changes and modifications can be made thereto without departing from the spirit and scope of embodiments of the invention as set forth herein.

What is claimed as new and desired to be secured by Letters Patent of the United States is:

1. An image forming apparatus, comprising:

an image bearing member configured to bear a latent electrostatic image thereon, the image bearing member comprising:

an electroconductive substrate; and a photosensitive layer located overlying the electroconductive substrate;

a charging device configured to charge the image bearing member;

an irradiation device configured to irradiate the image bearing member with light to form the latent electrostatic image on the image bearing member;

a developing device configured to develop the latent electrostatic image on the image bearing member with a toner to form a toner image on a surface of the image bearing member;

a cleaning device comprising:

a cleaning blade configured to scrape the surface of the image bearing member to remove particles of the toner remaining on the image bearing member, and a transfer device configured to transfer the toner image formed on the image bearing member to a recording material directly or by way of an intermediate transfer member, wherein the image forming apparatus satisfies the following relationships (1) and (2):

(1) 0.10< or =$Dm^3/V$< or 3.41, wherein Dm represents a weight average particle diameter of the toner and V represents a circumference velocity of the image bearing member; and (2) $T_{ave}$< or =1.40 kgf·cm, wherein $T_{ave}$ represents an average of a torque T of the image bearing member when the torque is measured for 15 seconds while the cleaning blade is in contact with the image bearing member.

2. The image forming apparatus according to claim 1, wherein the toner has a weight average particle diameter Dm of from 4.0 to 8.0 μm and the image bearing member has a circumference velocity V of from 150 to 600 mm/sec.

3. The image forming apparatus according to claim 1, wherein the image bearing member further comprises a protective layer which is an outermost layer of the photosensitive layer and which contains a particulate fluorine resin functioning as a solid lubricant in an amount of 20 to 60% by volume.

4. The image forming apparatus according to claim 3, wherein the protective layer further comprises a charge transport material.

5. The image forming apparatus according to claim 3, further comprising a contacting member configured to extend the particulate fluorine resin contained in the protective layer by scraping the surface of the image bearing member.

6. The image forming apparatus according to claim 5, wherein the cleaning blade functions as the contacting member.

7. The image forming apparatus according to claim 1, further comprising a member configured to supply a solid lubricant to an outermost layer of the image bearing member.

8. The image forming apparatus according to claim 1, further comprising at least one additional image bearing member.

9. The image forming apparatus according to claim 1, further comprising a process cartridge containing the image bearing member and at least one device selected from the group consisting of the irradiation device, the developing device and the cleaning device.

10. The image forming apparatus according to claim 1, wherein the toner used has an average circularity of from 0.93 to 1.00 and is prepared by a method in which a toner component comprising a particulate resin polymer having a portion reactive with a compound having an active hydrogen, a polyester, a colorant, and a releasing agent is cross-linked or elongated in an aqueous liquid under the presence of a particulate resin polymer.

11. The image forming apparatus according to claim 10, wherein particles of the toner have a substantially sphere form and a ratio (r2/r1) of a minor axis (r2) of the particles of the toner to a major axis (r1) thereof is from 0.5 to 1.0 and another ratio (r3/r2) of a thickness (r3) of the toner to the minor axis (r2) thereof is from 0.7 to 1.0, to satisfy relationship: major axis r1> or =minor axis r2> or =thickness r3.

12. An image forming apparatus, comprising:

means for bearing a latent electrostatic image thereon, the image bearing member comprising:

an electroconductive substrate; and a photosensitive layer located overlying the electroconductive substrate;

means for irradiating the means for bearing with light;

means for developing the latent electrostatic image on the means for bearing with a toner to form a toner image on a surface of the means for bearing;

means for cleaning comprising:

means for removing particles of the toner remaining on the means for bearing; and means for transferring the toner image formed on the means for bearing to a recording material directly or by an intermediate transfer member, wherein the image forming apparatus satisfies relationships (1) and (2):

(1) 0.10< or =$Dm^3/V$< or =3.41, wherein Dm represents a weight average particle diameter of the toner and V represents a circumference velocity of the image bearing member; and (2) $T_{ave}$< or =1.40 kgf·cm, wherein $T_{ave}$ represents an average of a torque T of the means for bearing when the torque is measured for 15 seconds while the means for removing particles is in contact with the means for bearing.

13. The image forming apparatus according to claim 12, wherein the toner has a weight average particle diameter Dm of from 4.0 to 8.0 μm and the means for bearing has a circumference velocity V of from 150 to 600 mm/sec.

14. The image forming apparatus according to claim 12, wherein the means for bearing further comprises a protective layer as an outermost layer of the photosensitive layer and which contains a particulate fluorine resin functioning as a solid lubricant in an amount of 20 to 60% by volume.

15. The image forming apparatus according to claim 14, wherein the protective layer further comprises a charge transport material.

16. The image forming apparatus according to claim 14, further comprising means for extending the particulate fluorine resin contained in the protective layer by scraping the surface of the means for bearing.

17. The image forming apparatus according to claim 16, wherein the means for removing particles functions as the means for extending the particulate fluorine resin.

18. The image forming apparatus according to claim 17, further comprising a process cartridge containing the means for bearing and at least one means selected from the group consisting of the means for irradiating, the means for developing, and the means for cleaning.

19. The image forming apparatus according to claim 12, further comprising means for supplying a solid lubricant to an outermost layer of the means for bearing.

20. The image forming apparatus according to claim 12, further comprising at least one additional means for bearing.

21. The image forming apparatus according to claim 12, wherein the toner used has an average circularity of from 0.93 to 1.00 and is prepared by a method in which a toner component comprising a particulate resin polymer having a portion reactive with a compound having an active hydrogen, a polyester, a colorant, and a releasing agent is cross-linked or elongated in an aqueous liquid under the presence of a particulate resin polymer.

22. The image forming apparatus according to claim 21, wherein particles of the toner have a substantially sphere form and a ratio (r2/r1) of a minor axis (r2) of the particles of the toner to a major axis (r1) thereof is from 0.5 to 1.0 and another ratio (r3/r2) of a thickness (r3) of the toner to the minor axis (r2) thereof is from 0.7 to 1.0, to satisfy relationship: major axis r1> or =minor axis r2> or =thickness r3.

* * * * *